US006585438B2

(12) United States Patent
Hosokawa et al.

(10) Patent No.: US 6,585,438 B2
(45) Date of Patent: Jul. 1, 2003

(54) TAPE PRINTING APPARATUS AND METHOD, CUTTING DEVICE AND METHOD, AND TAPE PRINTING APPARATUS INCORPORATING THE CUTTING DEVICE

(75) Inventors: Takeshi Hosokawa, Shiojiri (JP); Tomoki Nakamura, Tokyo (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 0 days.

(21) Appl. No.: 10/017,274

(22) Filed: Dec. 13, 2001

(65) Prior Publication Data

US 2002/0090243 A1 Jul. 11, 2002

(30) Foreign Application Priority Data

Dec. 25, 2000 (JP) ..... 2000-392654
Mar. 6, 2001 (JP) ..... 2001-062161

(51) Int. Cl.[7] ..... B41J 11/26
(52) U.S. Cl. ..... 400/621; 400/613
(58) Field of Search ..... 400/613, 611, 400/621, 621.1, 615.2

(56) References Cited

U.S. PATENT DOCUMENTS 5,066,152 A * 11/1991 Kuzuya et al. ..... 400/621
5,556,213 A * 9/1996 Kudo et al. ..... 400/621
5,937,725 A * 8/1999 Kamijo et al. ..... 83/880
5,957,597 A * 9/1999 Kato ..... 400/621
6,113,294 A * 9/2000 Niwa ..... 400/621
6,142,688 A * 11/2000 Saito ..... 400/621

FOREIGN PATENT DOCUMENTS

JP 05-092629 * 4/1993
JP 09-314938 * 9/1997
JP 2001-270647 * 2/2001
JP 2001-088381 4/2001
JP 2001-162881 * 6/2001

* cited by examiner

*Primary Examiner*—Andrew H. Hirshfeld
*Assistant Examiner*—Minh H. Chau
(74) *Attorney, Agent, or Firm*—Hogan & Hartson, LLP

(57) ABSTRACT

There are provided a tape printing apparatus and a tape printing method, which are capable of setting or determining whether or not half-cutting should be carried out, based on the detected type of a tape set for use, as well as a cutting device capable of detecting the type of a tape-shaped member, and setting whether or not the tape-shaped member should be cut, based on the detected type of the tape-shaped member, a tape printing apparatus incorporating the device, and a method for the cutting device. The tape printing apparatus has a half-cutting function of cutting only a peel layer of a tape-shaped member formed of an image-receiving layer and the peel layer and by using a half-cutting tape cutter in the direction of the width of the tape-shaped member. The type of the tape-shaped member is detected. Whether or not the half-cutting tape cutter is driven, based on a result of the detection. Printing is carried out on the tape-shaped member. When the half-cutter is set to be driven, the half-cutting tape cutter is driven to perform half-cutting of the image-receiving layer alone of the tape-shaped member at a forward location of the tape-shaped member in the direction of feed thereof.

23 Claims, 15 Drawing Sheets

THROUGH-CUTTING PERFORMED AFTER HALF-CUTTING OF LEADING END OF TAPE

ONLY THROUGH-CUTTING

TAPE PRINTING APPARATUS AND METHOD, CUTTING DEVICE AND METHOD, AND TAPE PRINTING APPARATUS INCORPORATING THE CUTTING DEVICE

BACKGROUND OF THE INVENTION

1. Field of the Invention

This invention relates to a tape printing apparatus having a half-cutting function capable of cutting only an image-receiving layer of a tape-shaped member comprised of the image-receiving layer and a peel layer in the direction of the width thereof, by using a half cutter, and a method therefor, and a cutting device capable of cutting a tape-shaped member by using a tape cutter and a method therefor, as well as a tape printing apparatus incorporating the cutting device.

2. Prior Art

Conventionally, there has been proposed a half-cutting device which has a capability of cutting only an image-receiving layer of a tape-shaped member comprised of the image-receiving layer and a peel layer, so as to make it easy to peel off the peel layer. For instance, a cutting device for a label printer, as proposed in Japanese Laid-Open Patent Publication (Kokai) No. 9-314938, has a first cutting blade for use in cutting only the peel layer and a second cutting blade for use in cutting only the image-receiving layer. This cutting device is capable of performing half-cutting and through-cutting as required by driving either or both of the cutting blades.

Usually, devices of the above-mentioned kind, which are capable of performing half-cutting, can employ not only tape-shaped members comprised of an image-receiving layer and a peel layer but also various kinds of print mediums. Depending on the print medium, however, it is sometimes no use or impossible to carry out half-cutting. For instance, when a print medium, such as a transfer tape or the like, formed of only one layer is used, it is no use to carry out half-cutting of the print medium since the medium has no peel layer. Further, when a print medium having a magnetic layer is used, the cutting blade of the device can be damaged by a half-cutting operation (also by a through-cutting operation), so that the print medium has to be cut by using scissors.

However, even when such print mediums as mentioned above which are obviously unsuitable for half-cutting are used, it has been conventionally necessary to carry out selection between the half-cutting method and the through-cutting method, in case of need of cutting the mediums. This is troublesome. Further, the two cutting methods require different cutting operations, which is also troublesome and inconvenient to users.

There have been also proposed tape printing apparatuses incorporating a cutting device capable of cutting a printed portion of a tape-shaped member to a desired length. These tape printing apparatuses can automatically cut a tape-shaped member to be delivered therefrom as printing operation proceeds, in a proper timing corresponding to a tape length calculated from print data, or manually cut off a printed portion of the tape-shaped member.

These tape printing apparatuses can use tape-shaped members comprised of component parts made of various kinds of materials and having different thicknesses. Depending on the materials and thickness of the component part, however, there are some which cannot be cut or which are considered to be unsuitable for cutting by the cutting device. For instance, when a tape-shaped member having a magnetic layer is employed, the tape cutter (cutting edge thereof) is damaged if it is used in cutting the tape-shaped member. Therefore, to cut such a tape-shaped member, it is required to use scissors, which makes the cutting operation very troublesome. Further, if such an unsuitable type of tape-shaped member is unintentionally used by the user, the resulting cutting operation carried out on the tape-shaped member by mistake can damage the tape cutter of the apparatus.

SUMMARY OF THE INVENTION

It is a first object of the invention to provide a tape printing apparatus having a half-cutting function, which is capable of setting whether or not half-cutting of the tape-shaped member should be carried out, based on the detected type of the tape-shaped member, and a method therefor.

It is a second object of the invention to provide a cutting device capable of detecting the type of a tape-shaped member, and setting whether or not the tape-shaped member should be cut, based on the detected type of the tape-shaped member, a tape printing apparatus incorporating the device, and a method for the cutting device.

To attain the first object, according to a first aspect of the invention, there is provided a tape printing apparatus which has a half-cutting function capable of cutting an image-receiving layer alone of a tape-shaped member in a direction of a width thereof by using a half cutter, the tape-shaped member having the image-receiving layer and a peel layer.

The tape printing apparatus according to the first aspect of the invention is characterized by comprising:

printing means for printing on the tape-shaped member;

tape-detecting means for detecting a type of the tape-shaped member;

half cutter-driving setting means for setting whether or not the half cutter should be driven, based on a result of detection by the tape-detecting means; and half-cutting means for performing half-cutting of the image-receiving layer alone of the tape-shaped member at a forward location of the tape-shaped member in a direction of feed thereof by driving the half cutter when the half cutter-driving setting means sets the half-cutter to be driven.

To attain the first object, according to a second aspect of the invention, there is provided a method of printing on a tape-shaped member by a tape printing apparatus which has a half-cutting function capable of cutting an image-receiving layer alone of the tape-shaped member in a direction of a width thereof by using a half cutter, the tape-shaped member having the image-receiving layer and a peel layer.

The method according to the second aspect of the invention is characterized by comprising the steps of:

detecting a type of the tape-shaped member;

setting whether or not the half cutter should be driven, based on a result of the detection;

performing half-cutting of the image-receiving layer alone of the tape-shaped member at a forward location of the tape-shaped member in a direction of feed thereof by driving the half cutter when the half-cutter is set to be driven; and printing on the tape-shaped member.

According to the tape printing apparatus and method, the type of a tape-shaped member is detected, and whether or not the half cutter should be driven is set based on the result of the detection. Therefore, when a tape-shaped member which requires half-cutting is detected, the half cutter is driven, whereas when a tape-shaped member which does not require half-cutting is detected, the half cutter is not driven. That is, the user does not have to set whether or not half-cutting should be performed each time it is necessary to cut the tape-shaped member. This makes it possible to simplify the setting operation.

Further, when a leading margin length can be set so as to perform the half-cutting of the leading end of a tape-shaped member, and at the same time when the leading margin length is shorter than the distance between a print head and a full cutter, it is possible to use a portion of a leading end portion of the tape-shaped member for carrying out the half-cutting of the leading end, which portion corresponds to the distance between the print head and the full cutter, which is normally cut off the tape-shaped member as an unnecessary portion. That is, a predetermined length of the tape-shaped member is not necessarily consumed for performing the half-cutting, but depending on the case, the length of a tape-shaped member which would otherwise be consumed for another reason can be made use of for the half-cutting.

Preferably, the tape-detecting means includes means for detecting whether or not the peel layer exists in the tape-shaped member, and the half cutter-driving setting means includes means for setting the half cutter to be inhibited from being driven when it is detected by the tape-detecting means that the peel layer does not exist in the tape-shaped member.

Preferably, the step of detecting a type of the tape-shaped member includes detecting whether or not the peel layer exists in the tape-shaped member, and the step of whether or not the half cutter should be driven includes the step of setting the half cutter to be inhibited from being driven when it is detected that the peel layer does not exist in the tape-shaped member.

According to these preferred embodiments, when it is detected that there is no peel layer in the tape-shaped member, the half cutter is set not to be driven. Therefore, when a tape-shaped member, such as a transfer tape, is formed of only one layer, and hence requiring no half-cutting operation, and a tape-shaped member which has too thick an image-receiving layer to carry out half-cutting thereof is detected, the half cutter is not driven. In other words, when a tape-shaped member which does not require half-cutting is used, the user does not have to set whether or not the half-cutting should be performed, which makes it possible to simplify the setting operation.

Preferably, the tape printing apparatus further includes half cutter-driving instructing means for instructing whether or not the half cutter should be driven by the half-cutting means, and the halfcutter-driving setting means includes means for setting the half cutter to be inhibited from being driven irrespective of the instruction given by the half cutter-driving instructing means, when it is detected by the tape-detecting means that the peel layer does not exist in the tape-shaped member.

According to this preferred embodiment, when it is detected that there is no peel layer in the tape-shaped member, it is possible to set the half cutter to be inhibited from being driven even if an instruction for driving the cutter is given. This makes it possible to dispense with a useless cutting process, such as half-cutting of a tape-shaped member requiring no half-cutting operation.

Preferably, the tape printing apparatus further includes setting information-notifying means for notifying the user of settings set by the halfcutter-driving setting means.

According to this preferred embodiment, the tape printing apparatus includes setting information-notifying means for notifying the user of settings set by the half cutter-driving setting means, and hence when using the tape printing apparatus, the user can confirm whether or not the apparatus is set to perform half-cutting.

Preferably, the tape printing apparatus further includes display means for displaying messages for the user, and the display means includes means for displaying a message notifying the user that the settings set by the half cutter-driving setting means are changed if the settings are changed.

According to this preferred embodiment, when the settings set by the half cutter-driving setting means are changed, a message notifying the user of the fact is displayed, so that the user can visually recognize that a setting concerning whether or not half-cutting should be carried out has been made (changed).

Preferably, the display means includes means for displaying a message notifying the user that an instruction given by the half cutter-driving instructing means is made invalid, when it is detected by the tape-detecting means that the peel layer does not exist in the tape-shaped member.

According to this preferred embodiment, when it is detected that there is no peel layer in the tape-shaped member, even if an instruction for driving the half cutter is given, it is possible to display a message notifying the user that the instruction is made invalid. This enables the user to confirm that there is no peel layer in the tape-shaped member in use and recognize that the half cutter is not driven.

To attain the above first object, according to a third aspect of the invention, there is provided a tape printing apparatus which has a half-cutting function capable of cutting a peel layer alone of a tape-shaped member in a direction of a width thereof by using a half cutter, the tape-shaped member having an image-receiving layer and the peel layer.

The tape printing apparatus according to the third aspect of the invention is characterized by comprising:

printing means for printing on the tape-shaped member;

tape-detecting means for detecting a type of the tape-shaped member;

half cutter-driving setting means for setting whether or not the half cutter should be driven, based on a result of detection by the tape-detecting means; and half-cutting means for performing half-cutting of the peel layer alone of the tape-shaped member at a forward location of the tape-shaped member in a direction of feed thereof by driving the half cutter when the half cutter-driving setting means sets the half-cutter to be driven.

According to this tape printing apparatus, only a peel layer of a tape-shaped member can be cut in the direction of the width of the tape-shaped member which has an image-receiving layer and the peel layer, by using the half cutter. Therefore, by cutting only the peel layer, it is possible to peel off the peel layer with ease. Further, it is possible to set whether or not half-cutting should be carried out, based on a result of detection of the type of the tape-shaped member. Therefore, the user does not have to take the trouble of performing the setting operation in printing on the tape-shaped member.

To attain the above second object, according to a fourth aspect of the invention, there is provided a cutting device which is capable of cutting a tape-shaped member by a tape cutter thereof, comprising:

tape-detecting means for detecting a type of the tape-shaped member;

tape cutter-driving setting means for setting whether or not the tape cutter should be driven, based on a result of detection by the tape-detecting means; and cutting means for cutting the tape-shaped member when the tape cutter-driving setting means sets the tape cutter to be driven.

To attain the above second object, according to a fifth aspect of the invention, there is provided a method of cutting a tape-shaped member by using a tape cutter, comprising the steps of:

detecting a type of the tape-shaped member;

setting whether or not the tape cutter should be driven, based on a result of the detection; and cutting the tape-shaped member when the tape cutter is set to be driven.

According to these cutting device and cutting method, the type of the tape-shaped member is detected, and whether or not the tape cutter should be driven is set based on a result of the detection. Therefore, the user does not have to take the trouble of setting as to whether it should be cut or not depending on the type of the tape-shaped member. This makes it possible to simplify the cutting operation for cutting a tape-shaped member.

Preferably, the tape-detecting means includes means for detecting whether or not the tape-shaped member is cuttable, and the tape cutter-driving setting means includes means for setting the tape cutter to be driven only when the tape-detecting means detects that the tape-shaped member is cuttable.

Preferably, the step of detecting a type of the tape-shaped member includes detecting whether or not the tape-shaped member is cuttable, and the step of setting whether or not the tape cutter should be driven includes setting the tape cutter to be driven only when the tape-shaped member is detected to be cuttable.

According to these preferred embodiments, the tape cutter is set to be driven only when the tape-shaped member is detected to be cuttable, thereby making it possible to prevent erroneous cutting of an uncuttable tape-shaped member. Further, only whether or not the tape-shaped member is cuttable is detected, and therefore it is possible to simplify the construction of an object to be detected (materials of a tape-shaped member) and the arrangement of a mechanism for detecting the object.

More preferably, the tape-detecting means includes means for detecting a thickness of the tape-shaped member, and the tape cutter-driving setting means includes means for setting the tape cutter to be driven only when the tape-detecting means detects that the thickness of the tape-shaped member is equal to or smaller than a predetermined thickness defined in advance.

More preferably, the step of detecting a type of the tape-shaped member includes detecting a thickness of the tape-shaped member, and the step of setting whether or not the tape cutter should be driven includes setting the tape cutter to be driven only when the thickness of the tape-shaped member is detected to be equal to or smaller than a predetermined thickness defined in advance.

According to these preferred embodiments, the tape cutter is set to be driven only when the thickness of the tape-shaped member is detected to be equal to or smaller than a predetermined thickness defined in advance. This makes it possible to prevent erroneous cutting of a tape-shaped member having a thickness larger than the predetermined thickness. That is, it is possible to eliminate the problem that the tape cutter is caused to engage with the tape-shaped member due to the thickness of the tape-shaped member.

More preferably, the tape-detecting means includes means for detecting materials of component parts forming the tape-shaped member, and the tape cutter-driving setting means includes means for setting the tape cutter to be driven only when the materials of the component parts detected by the tape-detecting means are predetermined cuttable materials defined in advance.

More preferably, the step of detecting a type of the tape-shaped member includes detecting materials of component parts forming the tape-shaped member, and the step of setting whether or not the tape cutter should be driven includes setting the tape cutter to be driven only when the materials of the component parts are detected to be predetermined cuttable materials defined in advance.

According to these preferred embodiments, the materials of component parts forming the tape-shaped member are detected, and if it is determined as a result of the detection that the materials of the component parts are predetermined cuttable materials, the tape cutter can be set to be driven. In other words, since the tape cutter is set to be driven only when materials defined on the cutting device side in advance are detected, it is possible to prevent a tape-shaped member having component parts made of uncuttable materials from being erroneously cut.

Preferably, the tape cutter-driving setting means includes means for setting the tape cutter to be inhibited from being driven only when the materials of the component parts detected by the tape-detecting means are predetermined uncuttable materials defined in advance.

Preferably, the step of setting whether or not the tape cutter should be driven includes setting the tape cutter to be inhibited from being driven only when the materials of the component parts are detected to be predetermined uncuttable materials defined in advance.

According to these preferred embodiments, when it is determined as a result of the detection of the tape-shaped member that the materials of the component parts are predetermined uncuttable materials, the tape cutter can be set not to be driven. This means that the tape cutter is set not to be driven only when materials defined (stored) in advance are detected. This makes it possible to eliminate the inconvenience that when a material, for instance, which is cuttable but not yet defined by the device since it is a newly developed material, is detected, the tape-shaped member is set not to be cut although it is comprised of component parts of cuttable materials.

Preferably, the tape-detecting means includes means for detecting a hardness of each of the component parts forming the tape-shaped member, and the tape cutter-driving setting means includes means for setting the tape cutter to be driven only when the hardness of each of the component parts detected by the tape-detecting means is equal to or smaller than a predetermined hardness defined in advance.

According to this preferred embodiment, the tape cutter can be set to be driven only when the hardness of each of the component parts forming the tape-shaped member is equal to or smaller than a predetermined hardness defined on the device side in advance. This makes it possible to prevent an erroneous cutting of a tape-shaped member including component parts having high hardness, thereby preventing the breakage and abrasion of the tape cutter.

Preferably, the tape-detecting means includes means for detecting an adhesion between the component parts forming the tape-shaped member, and the tape cutter-driving setting means includes means for setting the tape cutter to be driven only when the adhesion of each of the component parts detected by the tape-detecting means is equal to or smaller than a predetermined adhesion value defined in advance.

According to this preferred embodiment, it is possible to set the tape cutter to be driven only when the adhesion of the component parts is equal to or smaller than a predetermined adhesion value defined on the device side in advance. This makes it possible to prevent erroneous cutting of a tape-shaped member having a high adhesion, thereby preventing the cutting performance of the tape cutter from being degraded, due to adhesion of part of the tape-shaped member to the tape cutter. It should be noted that not the adhesion but the bonding strength of the tape-shaped member may be detected.

Preferably, the cutting device further includes tape cutter-driving instructing means for instructing whether or not the tape cutter should be driven, and the tape cutter-driving setting means includes means for setting whether or not the tape cutter should be driven based on an instruction given by the tape cutter-driving instructing means.

According to this preferred embodiment, it is possible to instruct whether or not the tape cutter should be driven. That is, it is possible to set whether or not the tape-shaped member should be cut as desired by the user.

Preferably, the tape cutter-driving setting means includes means for setting the tape cutter to be inhibited from being driven irrespective of the instruction given by the tape cutter-driving instructing means, when it is detected by the tape-detecting means that the tape-shaped member is uncuttable.

According to this preferred embodiment, when the tape-shaped member is detected to be uncuttable, the tape cutter can be set not to be driven irrespective of the instruction given by the user. That is, the tape cutter is set not to be driven even when the user erroneously instructs the device to cut the tape-shaped member. Therefore, the tape cutter can be prevented from being damaged and abraded.

Preferably, the cutting device further includes setting information-notifying means for notifying the user of information of settings set by the tape cutter-driving setting means.

According to this preferred embodiment, the user is notified of the information of settings made by the tape cutter-driving setting means. Therefore, the user can confirm whether or not the tape cutter is set to be driven while using the cutting device.

Preferably, the cutting device further includes display means for displaying messages for the user, and the display means includes means for displaying a message notifying the user that the settings by the tape cutter-driving setting means are changed if the settings are changed.

According to this preferred embodiment, when the settings made by the tape cutter-driving setting means are changed, a message notifying the user of the fact is displayed, so that the user can visually recognize that a setting concerning whether or not the tape cutter should be driven is made (changed).

Preferably, the display means includes means for displaying a message notifying the user that the instruction given by the tape cutter-driving instructing means is made invalid, when it is detected by the tape-detecting means that the tape-shaped member is uncuttable.

According to this preferred embodiment, when the tape-shaped member is detected to be uncuttable, even if an instruction for driving the tape cutter is given, a message can be displayed notifying the user that the instruction is made invalid. Therefore, the user can be informed that the tape-shaped member set for use includes uncuttable materials and that the tape cutter is not driven.

To attain the above second object, according to a sixth aspect of the invention, there is provided tape printing apparatus comprising:

a cutting device which is capable of cutting a tape-shaped member by a tape cutter thereof, including tape-detecting means for detecting a type of the tape-shaped member, tape cutter-driving setting means for setting whether or not the tape cutter should be driven, based on a result of detection by the tape-detecting means, and cutting means for cutting the tape-shaped member when the tape cutter-driving setting means sets the tape cutter to be driven; and a printing device for printing on the tape-shaped member.

This tape printing apparatus incorporates a cutting device which is capable of setting whether or not the tape cutter should be driven, based on a result of detection of the tape-shaped member. Therefore, the user does not have to take the trouble of performing the setting operation can be and printing can be carried out on the tape-shaped member.

The above and other objects, features, and advantages of the invention will become more apparent from the following detailed description taken in conjunction with the accompanying drawings.

DETAILED DESCRIPTION OF PREFERRED EMBODIMENTS

The invention will now be described in detail with reference to the drawings showing a tape printing apparatus according to a first embodiment thereof, and a cutting device and a tape printing apparatus incorporating the cutting device according to a second embodiment thereof.

Figure 1:
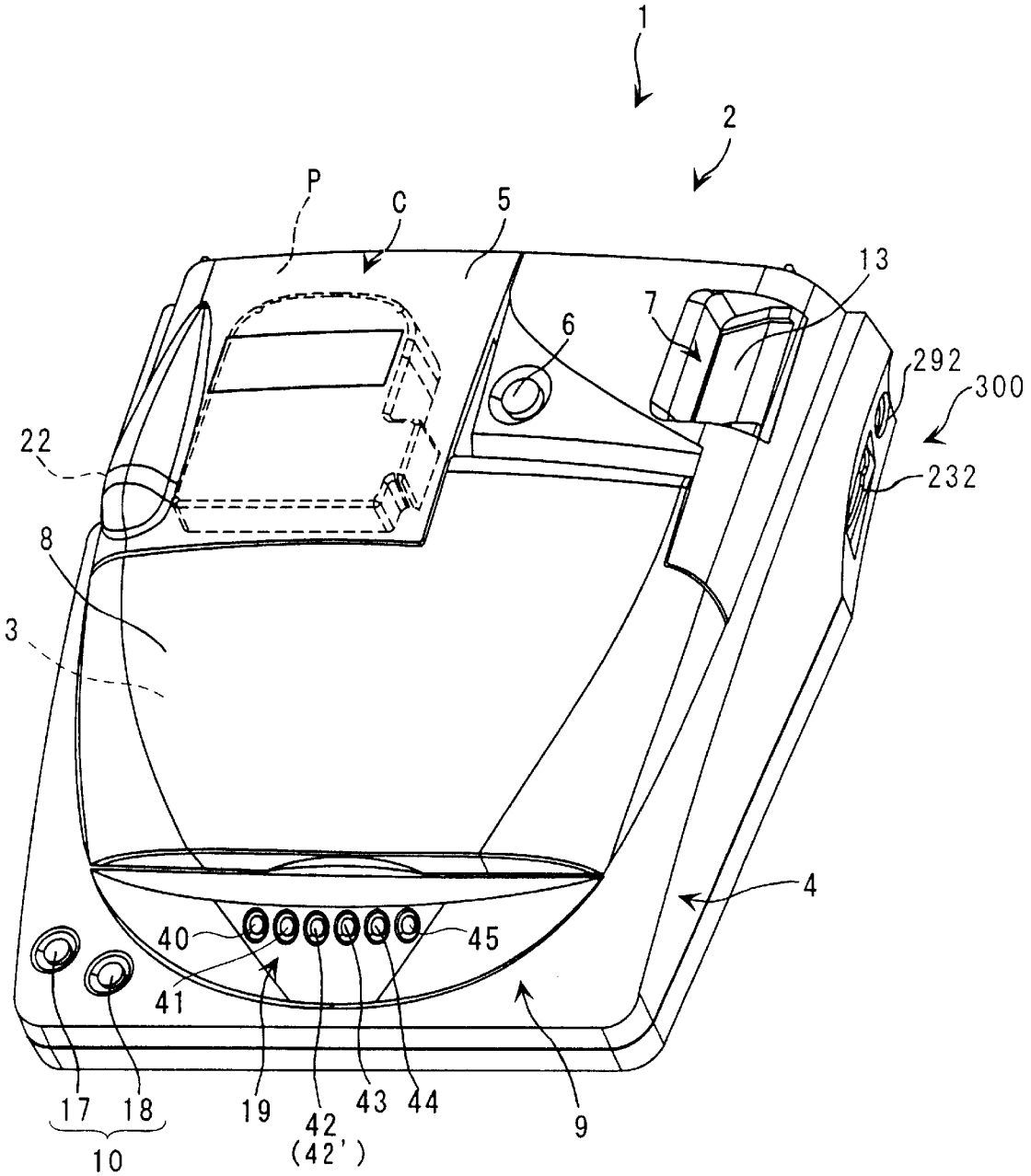
FIG. 1 is a perspective view of the appearance of a tape printing apparatus having a half-cutting function, according to an embodiment of the invention.
Figure 2:
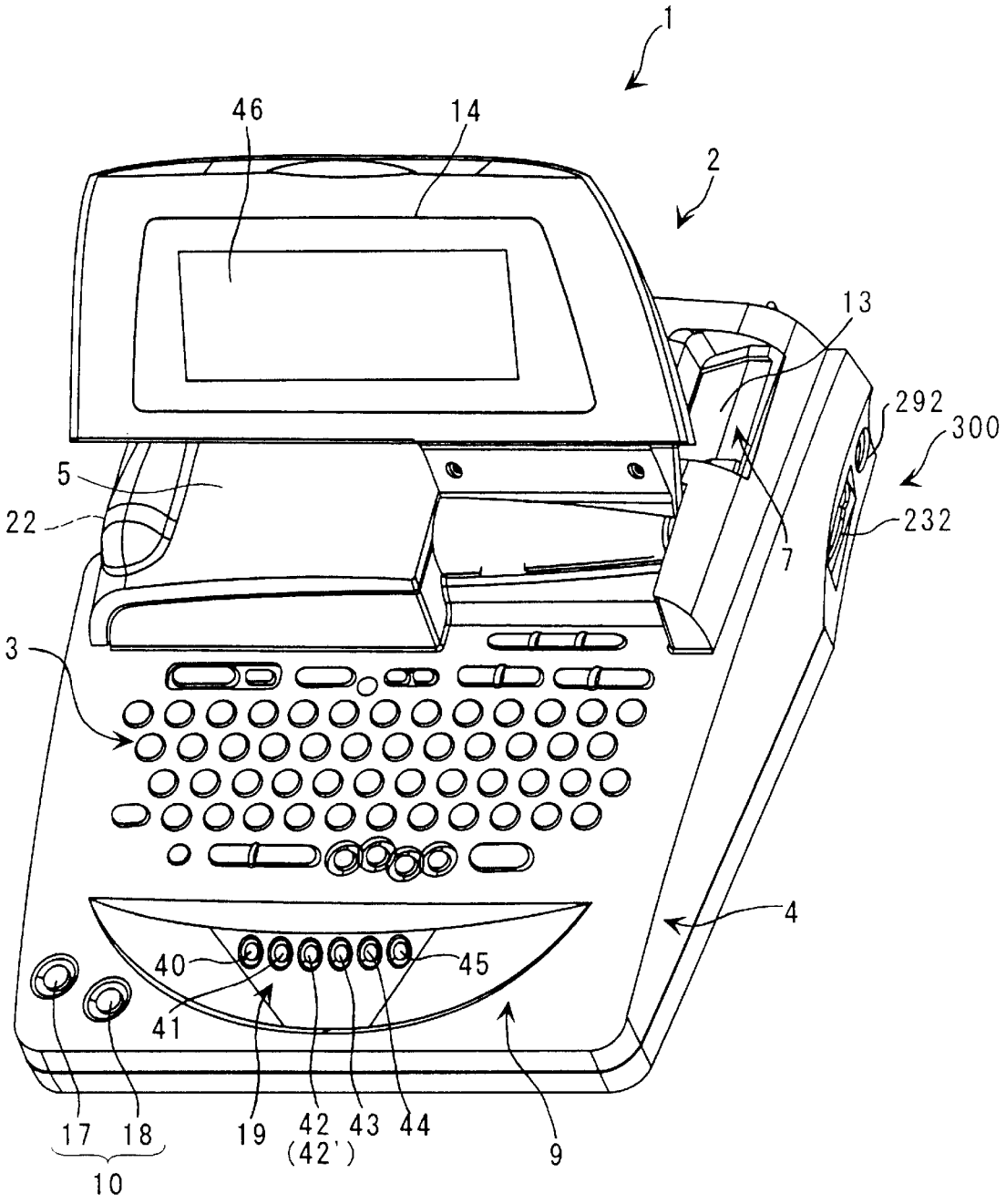
FIG. 2 is a perspective view of the appearance of the FIG. 1 tape printing apparatus with a cover assembly thereof open.

FIG. 1 shows the appearance of the whole tape printing apparatus 1 according to the first embodiment. FIG. 2 shows the tape printing apparatus 1 with a cover assembly 8 thereof open, while FIG. 3 shows the apparatus 1 with the cover assembly 8 thereof closed, and with a lid 5 thereof open and a tape cartridge C mounted therein.

Figure 3:
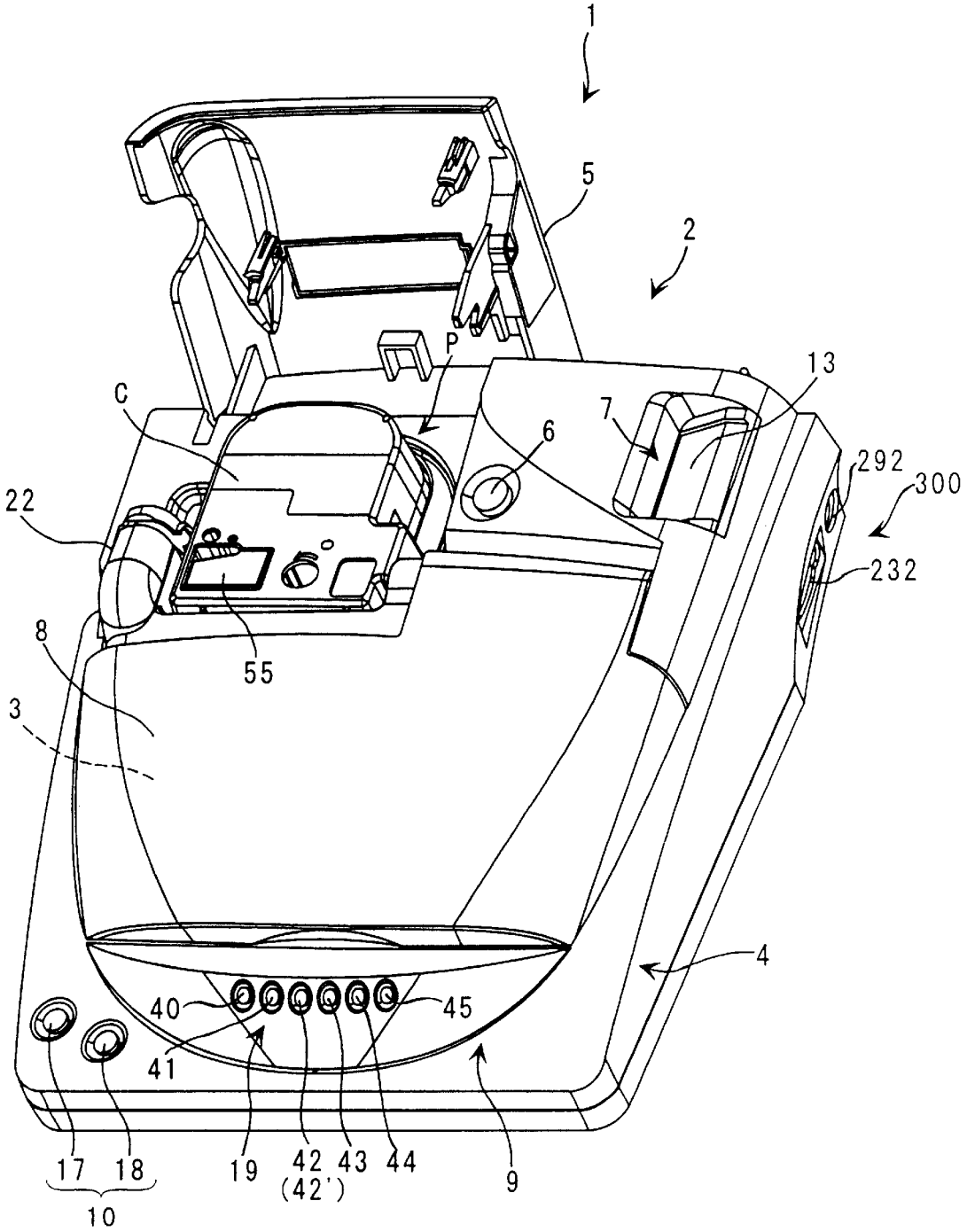
FIG. 3 is a perspective view of the appearance of the FIG. 1 tape printing apparatus with the cover assembly thereof closed, and with a lid thereof open and a tape cartridge mounted therein.

As shown in FIGS. 1 to 3, the tape printing apparatus 1 is comprised of a main unit 2 having an apparatus casing 4 forming an outer shell thereof, and the tape cartridge C removably mounted in the main unit 2. The main unit 2 is comprised of the lid 5 formed with a window, which is attached to the top of the rear left-hand portion of the apparatus casing 4, a lid-opening button 6 arranged at a location adjacent the right-hand side of the lid 5, for use in opening and closing the lid 5, a trimming device 7 arranged in the top of the apparatus casing 4 at a location rightward of the lid-opening button 6, the cover assembly 8 including a display 14 and mounted to the central portion of the apparatus casing 4 in a manner such that the cover assembly 8 can be opened and closed, and a crescent-shaped block 9 including an exposed lamp group 19 and raised upward from the apparatus casing 4 at a location forward of the cover assembly 8. Further, an exposed key group 10 comprised of two keys is arranged in the top of the apparatus casing 4 at a location leftward of the crescent-shaped block 9, and a keyboard 3 which is covered by the cover assembly 8 when the cover assembly 8 is closed and exposed when the cover assembly 8 is opened is arranged in the same plane where the exposed key group 10 is arranged. Under the lid 5, there is formed a compartment P in which the tape cartridge C is removably mounted.

As shown in FIGS. 1 to 3, according to the tape printing apparatus 1, a user opens the lid 5 by operating the lid-opening button 6, mounts the tape cartridge C in the compartment P, opens the cover assembly 8 to thereby make the keyboard 3 accessible for key entry, and then operates the keyboard 3 while viewing the display 14. When the user enters printing information, such as desired characters (letters, numerals, symbols, simple figures, etc.) and instructs the apparatus 1 to perform a printing operation via the keyboard 3, a tape T is unwound from the tape cartridge C, and desired printing is conducted on the tape T by a print head 122. The printed portion of the tape T is sent out via a tape exit 22 as the printing proceeds. When the desired printing is completed, the tape T is further advanced to a position corresponding to termination of a tape length (length of a label to be formed) including the length of margins, and then the feeding of the tape is stopped, followed by cutting off the portion of the tape T sent out with a through-cutting tape cutter 132*a* arranged thereat.

The corners of the cut-off strip of the printing tape T thus formed can be trimmed by the trimming device 7. More specifically, the user inserts the tape T into a slit of the trimming device 7 along a tape-inserting guide 13 sloped inwardly downward from the top of the apparatus casing 4, and a trimming mechanism of the device 7 automatically operates to trim the corners of the cut-off strip of the printing tape T into ones with a radius.

Figure 8A:
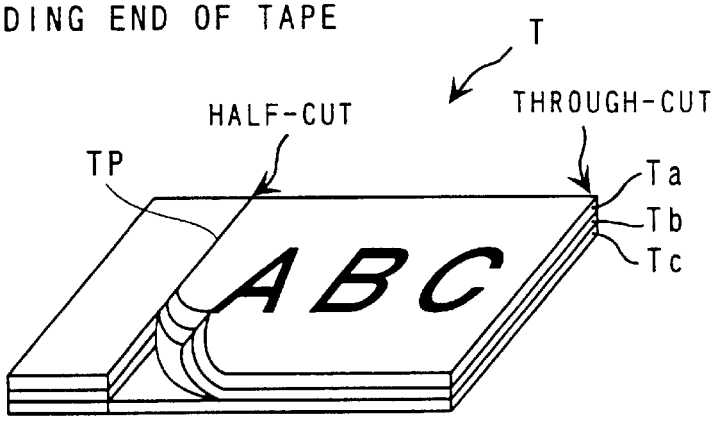
FIGS. 8A and 8B are diagrams showing layer structures of tapes for use in the FIG. 1 tape printing apparatus.
Figure 8B:
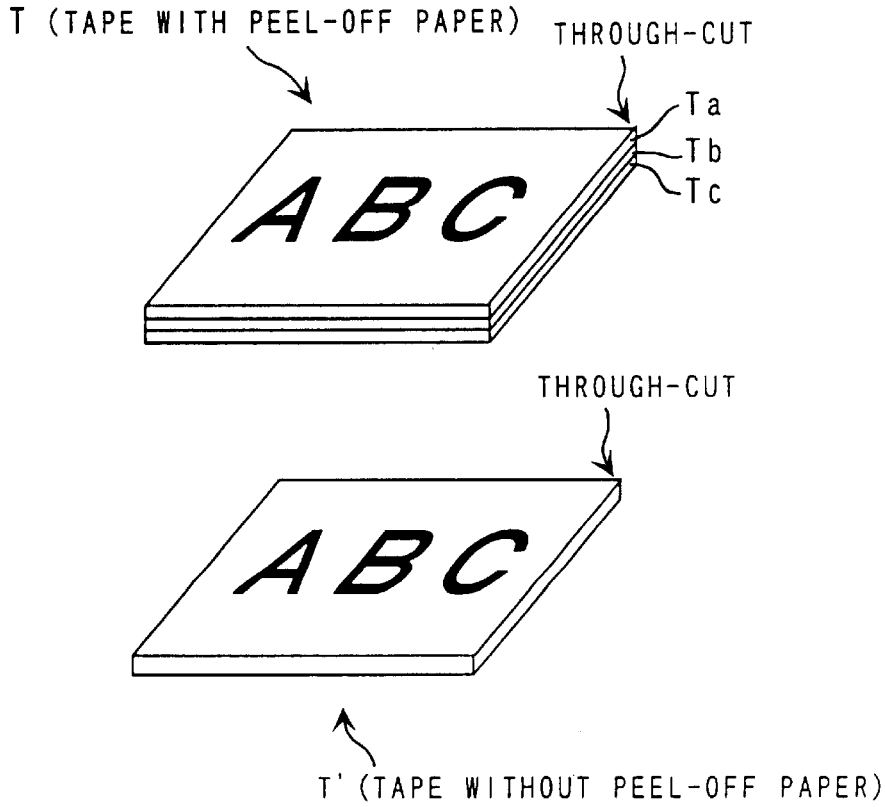
Figure 9:
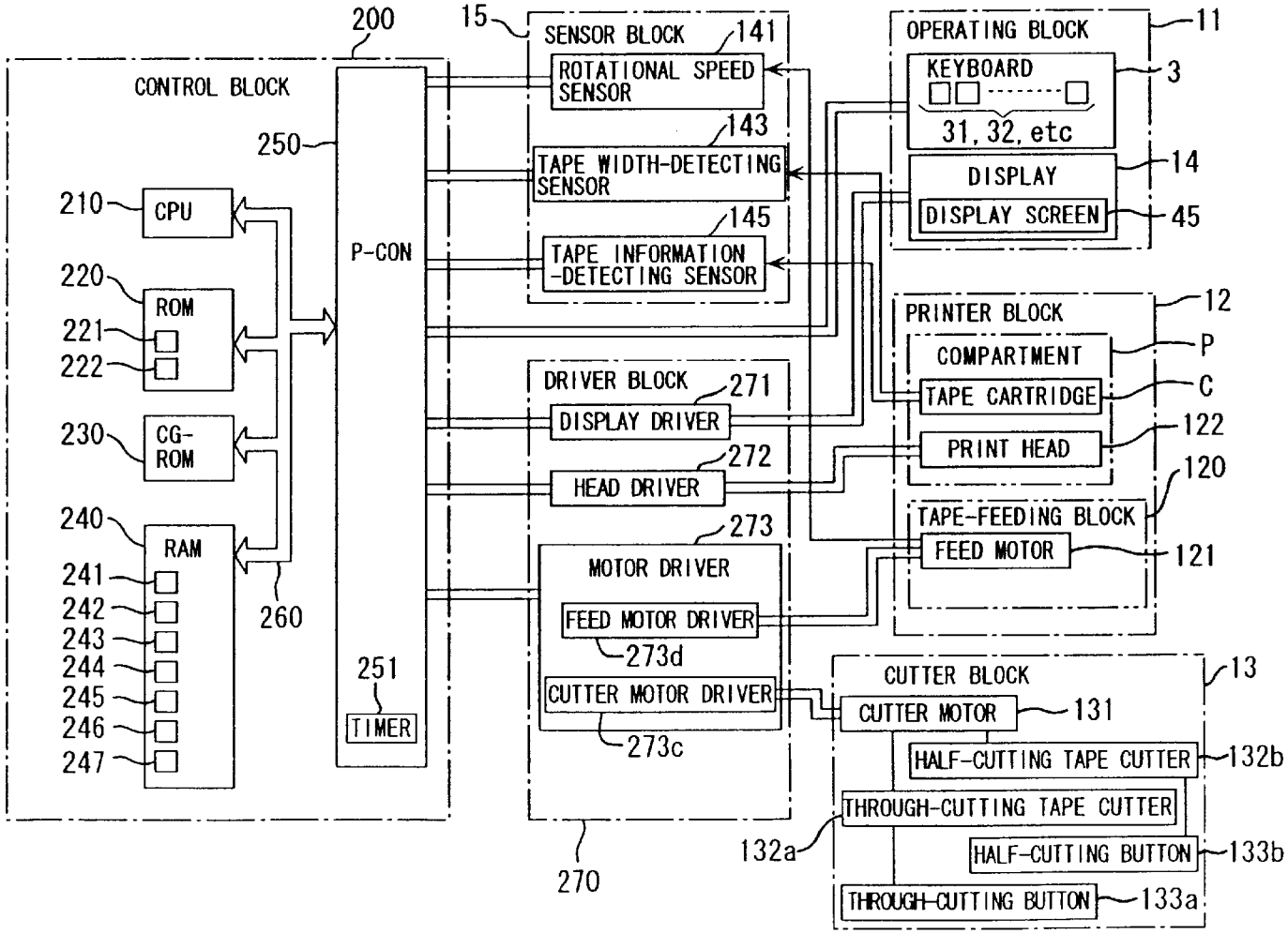
FIG. 9 is a block diagram showing the arrangement of a control system of a tape printing apparatus according to a second embodiment of the invention.

The tape T is comprised of an image-receiving layer Ta as a printing surface, an adhesive layer Tb coated on the underside surface of the image-receiving layer Ta, and a peel layer Tc peelably covering the underside surface of the adhesive layer Tb (see FIGS. 8A and 8B). The tape T and an ink ribbon R are fed or run such that they pass by a through hole 55, in a state lying one upon the other. Then, the tape T alone is delivered out of the tape cartridge C, whereas the ink ribbon R is taken up into a roll within the tape cartridge C. From the tape T delivered out of the apparatus, the peel layer Tc is peeled off, and then the tape T is affixed to an object article. It should be noted that in the tape printing apparatus 1, a single-layer tape T' (i.e. without the adhesive layer Tb and the peel layer Tc) shown in FIG. 8B, can also be used.

Further, the apparatus casing 4 has a connection terminal block 300 formed at a location opposite to the tape exit 22. The connection terminal block 300 is comprised of an AC adapter jack 292 for connecting an AC adapter, not shown, thereto, and a data-in jack 232 for connecting thereto a cable, not shown, which connects between the main unit 2 and a personal computer (PC). Since the connection terminal block 300 is arranged on the side opposite to the tape exit 22, the cable and the cord of the AC adapter, which are connected to the main unit 2, do not obstruct or interfere with picking up of a dispensed portion of the tape T. Further, the tape printing apparatus 1 is capable of printing print data entered by the personal computer PC on the tape T even when the apparatus is in an upright position with the rear surface thereof as the bottom directed downward.

The tape printing apparatus 1 is capable of printing data inputted and edited by the personal computer (PC) on a tape T by connecting between the main unit 2 and the PC with the cable. The tape printing apparatus 1 and the PC are placed in a communicative connection wait state by connecting between the main unit 2 and the PC by the cable, and the communicative connection wait state can be switched to a communicative connection-enabled state by turning on a communication key 18. When the tape printing apparatus 1 is communicatively connected to the PC as described above, it is not required to use the keyboard 3, and hence the keyboard 3 may be covered by the cover assembly 8 as shown in FIG. 1.

The exposed lamp group 19 is comprised of a plurality of indicator lamps arranged in the central portion of the crescent-shaped block 9. More specifically, the indicator lamps include a printing indicator lamp 40, a power supply indicator lamp 41, a half-cutting indicator lamp 42, a communication indicator lamp 43, and a trimming indicator lamp 44 arranged in the mentioned order from the left as viewed in FIGS. 1 to 3, and each indicator lamp is lighted (turned on) and extinguished (turned off) according to corresponding operating states of the apparatus 1. The printing indicator lamp 40 is on when the tape T is being subjected to printing and a printed portion of the tape T is being cut off by through-cutting, while the half-cutting indicator lamp 42 is on when the apparatus is set to partially cut (perform half-cutting of) a leading end portion of the tape T prior to printing (detailed description will be given hereinafter). The communication indicator lamp 43 is on when the communication key 18, referred to hereinafter, has been turned on. The trimming indicator lamp 44 is on during cutting and shaping of corners of a printed strip of the tape T by the trimming device 7.

The two keys of the exposed key group 10 are a power key 17 and the communication key 18 arranged immediately adjacent to each other on the respective left-hand side and the right-hand side. The power key 17 turns on and off the power of the main unit 2, while the communication key 18 enables and disables communicative connection between the apparatus 1 and the PC.

Figure 4:
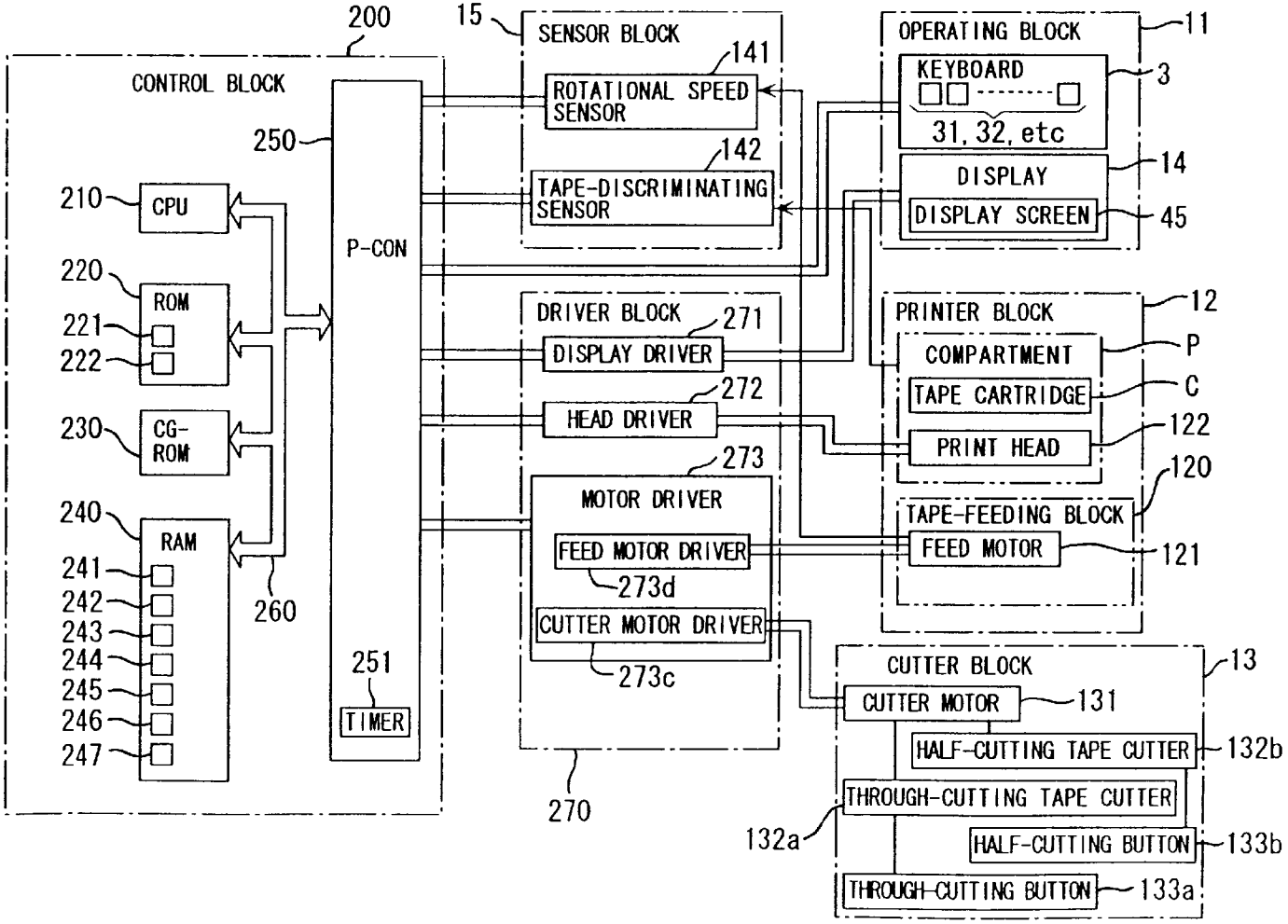
FIG. 4 is a block diagram showing the arrangement of a control system of the FIG. 1 tape printing apparatus.

Next, the basic arrangement of the control system of the printing apparatus 1 will be described. As shown in FIG. 4, the tape printing apparatus 1 is basically comprised of an operating block 11 having the keyboard 3 and the display 14 and interfacing with the user, a printer block 12 having a print head (thermal head) 122 and a tape feeder block 120 and performing printing on the tape T unwound from the tape cartridge C, a cutter block 13 for cutting the printed portion of the tape T, a sensor block 15 having various sensors for carrying out various detecting operations, a driving block 270 having drivers for driving circuits of various devices, and a control block 200 for controlling operations of components of the tape printing apparatus 1. To implement this construction of the present embodiment, the apparatus casing 4 accommodates a circuit board, not shown, in addition to the printer block 12, the cutter block 13, the sensor block 15 and so forth. On the circuit board, there are mounted a power supply unit, not shown, the circuits of the driving block 270 and the control block 200, etc. The power supply unit is connected to the aforementioned AC adapter jack 292 to which is connected the AC adapter connected to the AC power supply, not shown, and batteries, not shown, such as nicad batteries, which can be removably mounted in the main unit 2 from the outside thereof.

The operating block 11 is comprised of the keyboard 3 and the display 14. On the keyboard 3, there are arranged a character key group 31 including an alphabet key group, a number key group, and a nonstandard character key group for calling nonstandard characters for selection, as well as a function key group 32 for designating various operation modes. In a type of the apparatus which is capable of inputting the Japanese language, the character key group 31 also includes a kana key group for inputting Japanese hiragana letters and Japanese katakana letters. The function key group 32 includes a print key for instructing the apparatus 1 to execute printing, a selection key for use in selecting a desired function from displayed menu options (or for use in selecting a desired kanji letter from candidates kanji letters presented in kana-kanji conversion which is executed by the type of apparatus capable of entering the Japanese language), a delete key for deleting characters designated by a cursor (see D12 in FIG. 6) or canceling operations carried out for various functions, and four cursor keys (up arrow key, down arrow key, left arrow key, and right arrow key) for moving the cursor K in respective upward, downward, leftward, and rightward directions, for designating a position at which a character is entered next or a position at which operation is carried out. The function key group 32 further includes a half-cutting key for instructing execution of half-cutting of the leading end of the tape T prior to a printing operation.

Needless to say, the above key entries may be made by provision of respective keys or by provision of a smaller number of keys which can be operated in combination with a shift key or the like. As shown in FIG. 4, various commands and data are inputted to the control block 200 via the keyboard 3.

The display 14 has a display screen 45 which is capable of displaying display image data of 96 by 64 dots on a rectangular display area of approximately 6 cm in the horizontal direction (X direction) by 4 cm in the vertical direction (Y direction). The display 4 is made use of by the user when he enters data via the keyboard 3 to form or edit print image data, such as character string image data, views the resulting data, and enters various commands including ones for selecting menu options via the keyboard 3.

The tape feeder block 120 includes a feed motor 121 for feeding the tape T. The feed motor 121 has an end thereof rigidly fixed to a disc, not shown, formed with detection openings, and a rotational speed sensor 141 including a photo sensor or the like is arranged such that the sensor 141 faces the rotational path of the detection openings, for sending information of the rotational speed of the feed motor 121 detected thereby to the control block 200.

The printer block 12 has the compartment P formed under the lid 5, for receiving the tape cartridge C therein. The tape cartridge C can be mounted in or removed from the compartment P when the lid 5 is open. The tape cartridge C has a cartridge casing 51 holding the tape T and the ink ribbon R each having a predetermined width (approximately 4.5 to 48 mm). Further, the tape cartridge C is formed with the through hole 55 for receiving therein a head unit arranged in the compartment P. The tape cartridge C also has a plurality of small holes formed in the bottom thereof, for discrimination of the type of the tape T contained therein from the other types of the tape T having different widths, which are contained in other tape cartridges C. The compartment P has a tape-discriminating sensor 142, implemented e.g. by micro-switches, for detecting the above holes to thereby determine the type of the tape T set for use.

The cutter block 13 is comprised of the through-cutting tape cutter 132*a* for cutting through the tape T, a half-cutting tape cutter (half cutter) 132*b* for cutting only the image-receiving layer Ta and adhesive layer Tb of the tape T, through-cutting and half-cutting cutting buttons 133*a*, 133*b* to be manually operated for causing the respective tape cutters 132*a*, 132*b* to cut the tape T e.g. in the case of desired length printing, and a cutter motor 131 for automatically driving the tape cutters 132*a*, 132*b* to cut the tape T e.g. in the case of fixed length printing. The tape printing apparatus 1 can be switched between a manual cutting mode and an automatic cutting mode by a cutting mode-setting operation. In the manual cutting mode, after completion of a printing operation, the user pushes the cutting buttons 133*a*, 133*b* arranged on the apparatus casing 4, whereby the tape cutters 132*a*, 132*b* are actuated to cut the tape T to a desired length. On the other hand, in the automatic cutting mode, after completion of a printing operation, the tape T is sent for additional feed by the length of a rear margin, and then stopped, whereupon the cutter motor 131 is driven for cutting the tape T.

When the automatic cutting mode is set according to the mode-setting operation, the type of the tape T is detected by the tape-discriminating sensor 142, referred to hereinafter, and based on a result of the detection, it is set whether or not the half-cutting of the leading end of the tape T should be carried out prior to a printing operation. In this embodiment, the half-cutting is carried out such that only the image-receiving layer Ta and adhesive layer Tb of the tape T are cut to leave the peel layer (peel-off paper) Tc uncut so as to make it easy to peel off the peel-off paper Tc. This makes it possible to form a tab-shaped tape T with a slit (see FIG. 8A). Detailed description thereof will be given hereinafter.

The sensor block 15 includes the rotational speed sensor 141 and the tape-discriminating sensor 142. It should be noted that, to suit the actual requirements of the tape printing apparatus 1, it is possible to omit these sensors.

The driving block 270 is comprised of a display driver 271, a head driver 272, and a motor driver 273. The display driver 271 drives the display 14 of the operating block 11 in response to control signals delivered from the control block 200, i.e. in accordance with commands therefrom. Similarly, the head driver 272 drives the print head 122 of the printer block 12, in accordance with commands from the control block 200. The motor driver 273 includes a feed motor driver 273*d* for driving the feed motor 121 of the printer block 12, and a cutter motor driver 273*c* for driving the cutter motor 131 of the cutter block 13. Similarly to the above drivers, the motor driver 273 drives each motor in accordance with commands from the control block 200.

The control block 200 includes the CPU 210, a ROM 220, a character generator ROM (CG-ROM) 230, a RAM 240, a peripheral control circuit (P-CON) 250, all of which are connected to each other by an internal bus 260. The ROM 220 has a control program area 221 for storing control programs executed by the CPU 210 as well as a control data area 222 for storing control data including a character table, a color conversion table and a character modification table. The CG-ROM 230 stores bitmap data of symbols, figures and the like, which is provided for the tape printing apparatus 1. When code data specifying a character or the like is inputted thereto, it outputs the corresponding bitmap data.

The RAM (storage device) 240 is supplied with power by a backup circuit, not shown, such that stored data items can be preserved even when the power is turned off by operating the power key 17. The RAM 240 includes areas of a register group 241, a character data area 242 for storing character data of letters or the like entered by the user via the keyboard 3, a display image data area 243 for storing image data displayed on the display screen 45, a print image data area 244 for storing print image data, a registered image data area 245 for storing registered image data, as well as a print history data area 246 and conversion buffer areas 247 including color conversion buffers. The RAM 240 is used as a work area for carrying out various control processes.

The P-CON 250 incorporates logic circuits for complementing the functions of the CPU 210 and for dealing with interface signals for interfacing between the CPU 210 and peripheral circuits. The logic circuits are implemented by gate arrays, a custom LSI and the like. For instance, a timer 251 is incorporated in the P-CON 250 for the function of measuring elapsed time. The P-CON 250 is connected to the sensors of the sensor block 15 and the keyboard 3, for receiving the above-mentioned signals generated by the sensor block 15 as well as commands and data entered via the keyboard 3, and inputting these to the internal bus 260 directly or after processing them. Further, the P-CON 250 cooperates with the CPU 210 to output data and control signals inputted to the internal bus 260 by the CPU 210 or the like, to the driving block 270 directly or after processing them.

The CPU 210 receives the signals from the sensor block 15, the commands and data inputted via the keyboard 3, etc. via the P-CON 250, according to the control programs read from the ROM 220, processes bitmap data from the CG-ROM 230 and various data stored in the RAM 240, and delivers control signals to the driving block 270 via the P-CON 250 to thereby carry out position control during printing operations, display control of the display screen 45, etc. Further, the CPU 210 causes the print head 122 to carry out printing on the tape T under predetermined printing conditions. In short, the CPU 210 controls the overall operation of the tape printing apparatus 1.

Now, a half-cutting function-setting process of the tape printing apparatus 1 will be described. As described above, in the tape printing apparatus 1 according to the present invention, the type of the tape T is detected by the tape-discriminating sensor 142, and based on the result of the detection, it is set whether or not the half-cutting of the leading end of the tape T should be carried out prior to a printing operation. Now, the overall flow of the half-cutting function-setting process according to the invention will be described with reference to FIG. 5. Here, let it be assumed that the cutting mode is set not to the "manual cutting mode" but to the "automatic cutting mode", and that a tape T (tape cartridge C) is mounted after the power is turned on. Further, it is assumed that in detection of the type of the tape T, it is determined whether or not the tape T has a peel-off paper (peel layer) Tc.

Figure 5:
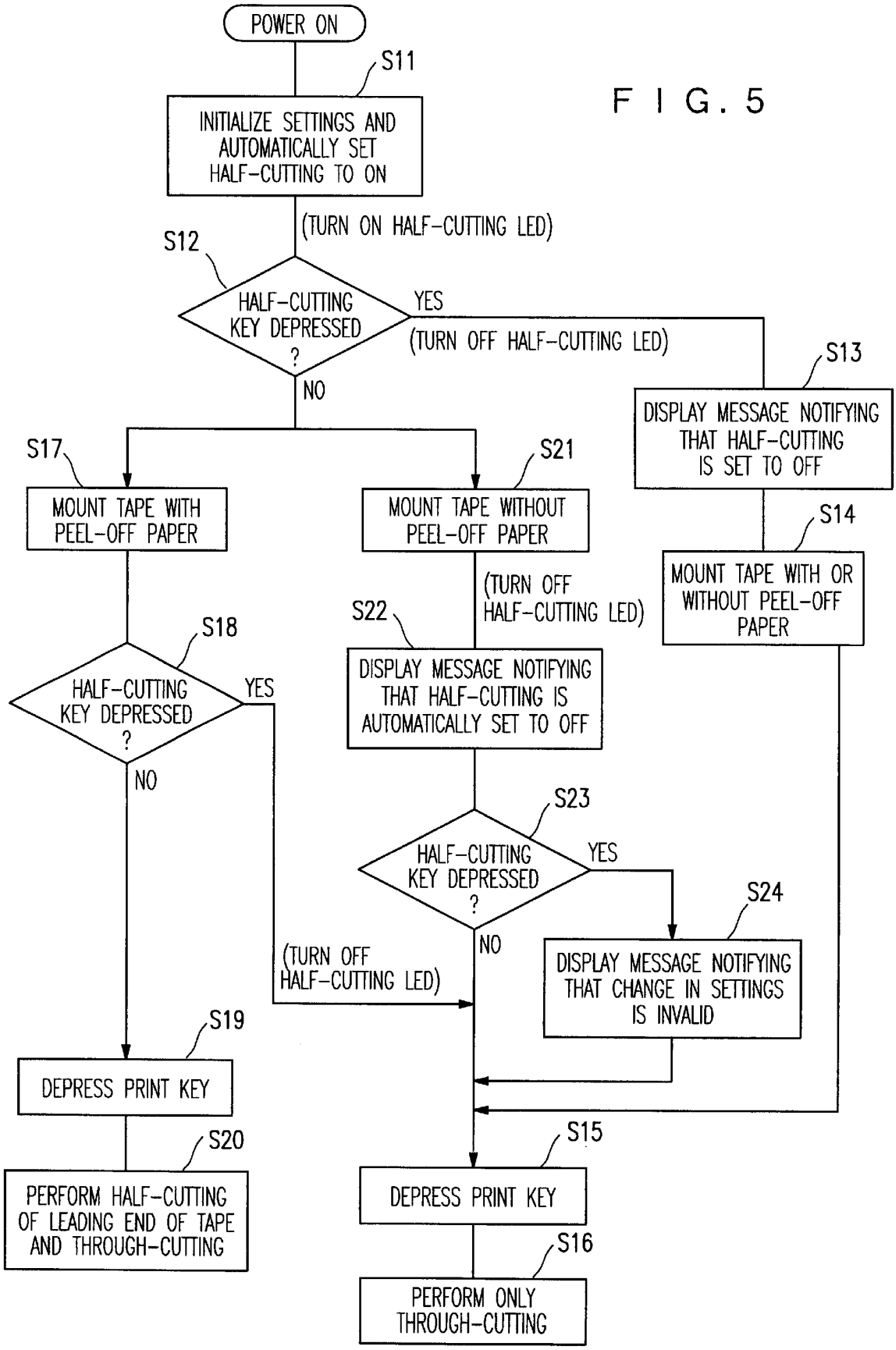
FIG. 5 is a flowchart showing an overall flow of a half-cutting function-setting process carried out by the FIG. 1 tape printing apparatus.

Referring to FIG. 5, when the power is turned on by the user, a predetermined initialization of the system is carried out at a step S11. Here, when the power of the tape printing apparatus 1 was turned off the last time, if half-cutting was set to ON, the ON state of half-cutting is maintained. On the other hand, when the power of the tape printing apparatus 1 was turned off the last time, if half-cutting was set to OFF, the OFF state is maintained after the power is turned on. Hence, it is assumed here that half-cutting is set to ON, and in accordance with this setting, the half-cutting indicator lamp (hereinafter referred to as the "half-cutting LED") 42 arranged at the central portion of the crescent-shaped block 9 is lighted.

Figure 6:
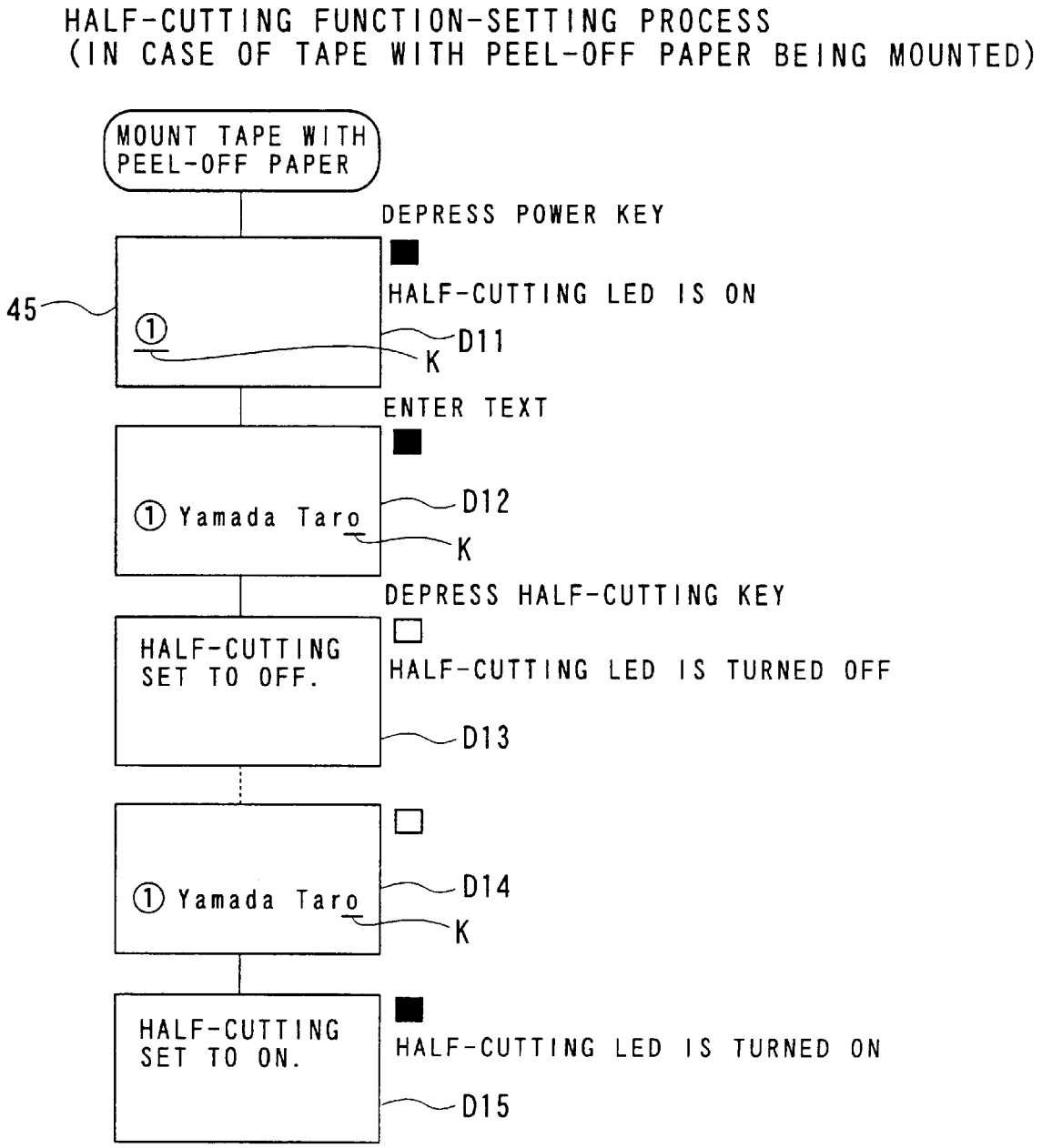
FIG. 6 is a diagram showing an example of the half-cutting function-setting process when a tape with a peel-off paper is set in the tape printing apparatus, together with images displayed on a display screen.

After the half-cutting LED 42 is lighted, when the half-cutting key is depressed by the user (Yes to S12), the half-cutting LED 42 is turned off, and a message notifying the user that half-cutting is set to OFF is displayed at a step S13 (see D13 in FIG. 6). In this state, when a tape T is mounted at a step S14 (in this case, the tape T may be a tape with or without a peel-off paper Tc), and the print key is depressed at a step S15, half-cutting to be effected prior to the printing operation is not carried out, but at a step S16 only through-cutting of the trailing edge of the tape T is effected after completion of printing (see FIG. 8B).

On the other hand, if the half-cutting key is not depressed by the user (No to S12), and the tape T with the peel-off paper Tc is mounted thereafter at a step S17, when the print key is depressed at a step S19 (without depressing the half-cutting key at a step S18 (No to S18)), the half-cutting of the leading end of the tape T is effected prior to a printing operation at a step S20 (see FIG. 8A). As described above, by carrying out the half-cutting, it becomes possible to easily peel off the peel-off paper Tc. More specifically, when the user seizes opposite ends of the tape T which has been cut off into a short strip, and curves the portion of the tape T subjected to the half-cutting such that the image-receiving layer Ta of the portion becomes outward, the peel-off paper Tc is naturally starts to be peeled off the portion subjected to the half-cutting. That is, by making the peel layer Tc easy to peel off, it is possible to enhance the operation efficiency of the user. It should be noted that after the half-cutting, printing is carried out, and then the through-cutting of the trailing edge of the tape T is effected.

After the tape T with the peel-off paper Tc has been mounted by the user at the step S17, if the half-cutting key is depressed (Yes to S18), the half-cutting LED 42 is turned off, and when the print key is depressed at the step S15, only through-cutting is performed after printing is completed (see FIG. 8B).

Figure 7:
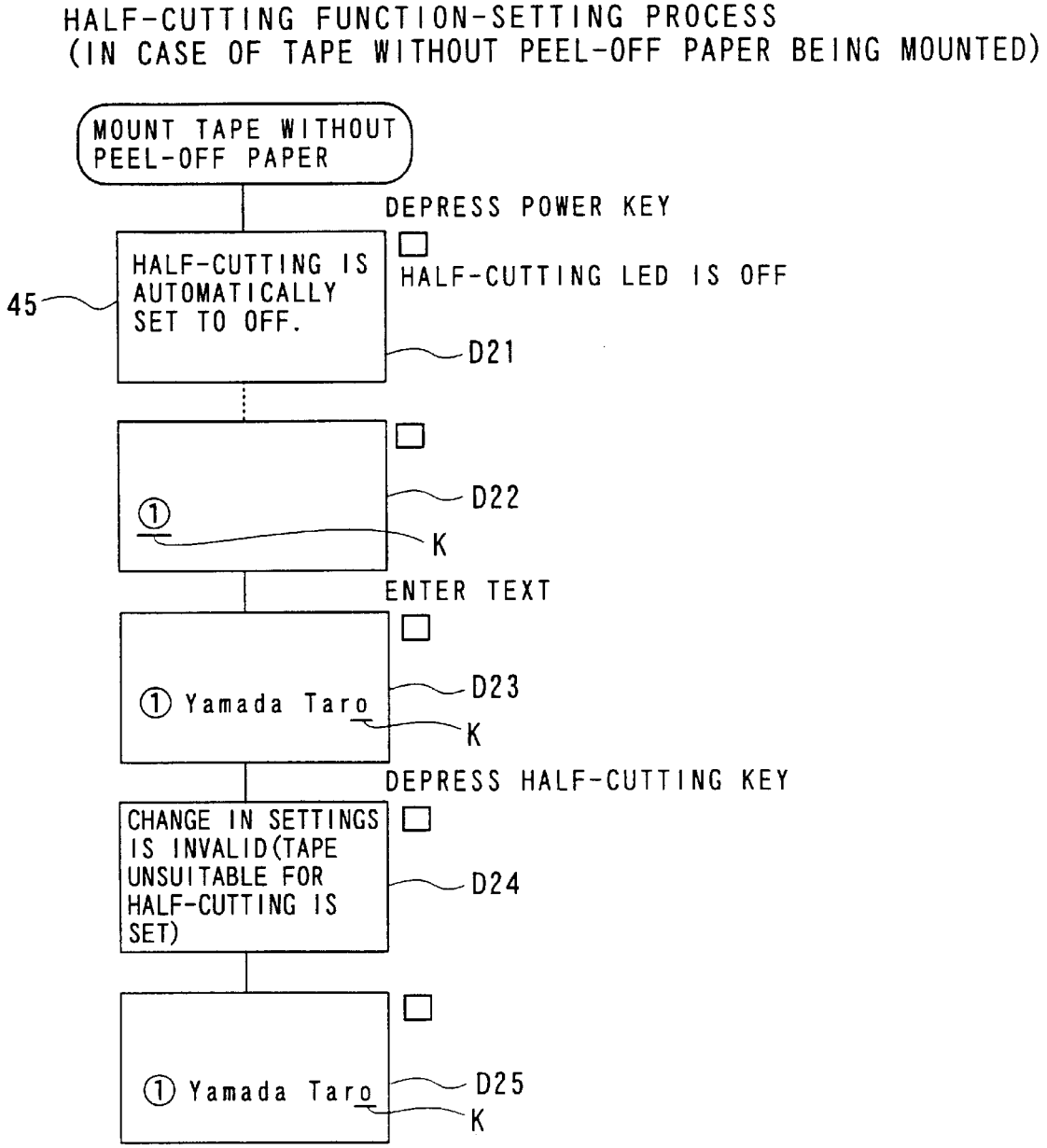
FIG. 7 is a diagram showing an example of the half-cutting function-setting process when a tape without a peel-off paper is set in the tape printing apparatus, together with images displayed on the display screen.

Further, if the tape T (tape T': see FIG. 8B) without the peel-off paper Tc (and the adhesive layer Tb) is mounted by the user at a step S21, the half-cutting LED 42 is turned off, and a message is displayed for notifying the user that half-cutting is automatically set to OFF at a step S22 (see D21 in FIG. 7). Here, if the half-cutting key is not depressed (No to S23), but the print key is depressed at the step S15, only through-cutting is carried out at the step S16 after completion of printing. On the other hand, if the half-cutting key is depressed (Yes to S23), a message notifying the user that the change in settings is invalid is displayed at a step S24 (see D24 in FIG. 7). This is because it is no use to carry out half-cutting when the tape T (tape T') without the peel-off paper Tc has been mounted. After the step S24 is carried out, when the print key is depressed at the step S15, only through-cutting is carried out at the step S16 after completion of printing.

If the apparatus is configured such that the power thereof is turned off when the tape T (cartridge C) is replaced (i.e. when the lid 5 is opened) so as to prevent the removal of the tape T (cartridge C) being fed to thereby prevent a faulty printing operation, it is preferred that the apparatus is configured such that the kind of tape T mounted therein is detected immediately after the power is tuned on. In this case, when a tape T with the peel-off paper is detected, the step S18 et seq., described above, are carried out, whereas when a tape T without the peel-off paper is detected, the step S22 et seq., described hereinabove, are carried out.

Therefore, the half-cutting function-setting process of the tape printing apparatus which is configured such that the power thereof is turned off in replacing a tape T, as described above, will be described according to the operating procedure with reference to images displayed on the display screen 45 shown in FIGS. 6 and 7. First, a case of the tape with the peel-off paper Tc being mounted in the apparatus will be described. As shown in FIG. 6, after the tape with the peel-off paper Tc is mounted, when the power key is depressed, a text entry screen is displayed (D11). It should be noted that encircled number 1 appearing on the display screen 45 indicates that a letter string is to be entered on a first line of text data. Further, at this time, the half-cutting LED 42 is on.

At this time, text data"Yamada Taro"is input (D12). Then, when the half-cutting key is depressed, the half-cutting LED 42 is turned off, and the message notifying the user that half-cutting has been set to OFF is displayed (D13). After the message has been displayed for one or two seconds, the screen is switched to the text entry screen (D14). In this state, when the half-cutting key is depressed again, the half-cutting LED 42 is lighted, and a message notifying the user that half-cutting has been set to ON is displayed (D15)

Next, a case of the tape without the peel-off paper Tc being mounted in the apparatus will be described. Referring to FIG. 7, after the tape without the peel-off paper Tc is mounted, when the power key is depressed, the message notifying the user that half-cutting has been automatically set to OFF is displayed (D21). At this time, the half-cutting LED 42 is off. Further, after the message has been displayed for one or two seconds, the screen is switched to the text entry screen (D22).

Here, after the text data"Yamada Taro"is input (D23), if the half-cutting key is depressed, the message notifying the user that the change in settings is invalid is displayed (D24) since the tape which cannot be subjected to the half-cutting is mounted. After the message has been displayed for one or two seconds, the screen is switched to the text entry screen (D25).

As described hereinabove, according to the tape printing apparatus having the half-cutting function and the half-cutting method therefor of the invention, the type of the tape T is detected, and based on the result of the detection, it is possible to automatically set whether or not the half-cutting of the leading end of the tape T should be carried out prior to printing. Therefore, when a tape T of which half-cutting is useless (e.g. a tape T having no peel-off paper Tc thereon) is employed, the user does not have to switch the setting of half-cutting such that half-cutting operation is inhibited, thereby making it possible to simplify the setting operation. Further, even when a tape T provided with the peel-off paper Tc is used, it is possible to switch the setting of half-cutting such that half-cutting operation is not carried out, according to an instruction by the user. Further, the user is notified by the half-cutting LED 42 as to whether or not the half-cutting is set to be carried out, and when the settings of half-cutting are changed, the notification of this change is displayed on the display screen 45, which contributes to enhancement of the operability of the apparatus.

Although in the above embodiment, it is assumed that the type of the tape T set for use is determined by detecting the holes formed in the bottom of the tape cartridge C containing the tape T, this is not limitative, but the type of the tape T may be detected e.g. by an identifier tape affixed to the tape cartridge C (for instance, a tape cartridge C containing the tape with the peel-off paper Tc may have a black identifier tape affixed thereto, whereas a tape cartridge C containing the tape without the peel-off paper Tc may have a white identifier tape affixed thereto).

Further, although in the above embodiment, it is assumed that in the detection of the type of the tape T, it is detected whether or not the tape T has a peel-off paper Tc, this is not limitative, but it is preferred that the apparatus is configured such that not only the presence or absence of the peel-off paper Tc but also more detailed information of the tape T, such as the material of the tape T or the like, is detected. According to this configuration, when a tape T is detected which includes not only the peel-off paper Tc but also a magnetic layer, and hence can damage a cutter blade if half-cutting is carried out, the apparatus can be set to be inhibited from performing half-cutting of such a tape T. In this case, it is preferred that the apparatus is constructed not to carry out through-cutting, either. This makes it possible to eliminate the inconvenience that the cutter blade is damaged by an improper cutting operation.

Also, it is preferred that the apparatus is set to be inhibited from carrying out half-cutting when a tape is detected which has such a thick image-receiving layer Ta as will make it impossible to effect half-cutting. Thus, half-cutting is not carried out on a tape-shaped member which does not require half-cutting, whereby it is possible to dispense with a useless portion of the leading end of the tape required for half-cutting (left-side portion from the leading edge TP of (the printed portion of) the tape T, as viewed in FIG. 8A).

Although the half-cutting tape cutter 132*b* is used for cutting the image-receiving layer Ta and the adhesive layer Tb of the tape T, the half-cutting tape cutter 132*b* may be used for cutting only the peel layer Tc, thereby facilitating the peeling-off of the peel layer Tc. Further, it is possible to apply the half-cutting method according to the invention to an apparatus which is capable of performing half-cutting and through-cutting operations by using a single cutter without using two types of cutters for half-cutting and through-cutting.

Next, a cutting device, a tape printing apparatus incorporating the device, and a cutting method according to a second embodiment of the invention will be described in detail. The cutting device, the tape printing apparatus incorporating the device, and the cutting method according to the present embodiment are constructed similarly to the tape printing apparatus according to the first embodiment with the exception of the following component parts and elements, so that in the following description of the present embodiment, component parts and elements similar to those of the tape printing apparatus according to the above embodiment are designated by identical reference numerals, and detailed description thereof is omitted.

In this embodiment, the exposed lamp group 19 further includes an automatic cutting indicator lamp 42' which is lighted when the function of automatically cutting a tape T is set (detailed description will be given hereinafter), in place of the half-cutting indicator lamp (half-cutting LED) 42.

The function key group 32 of the keyboard 3 includes an automatic cutting key for use in instructing the ON/OFF setting of the automatic cutting function of cutting the tape T automatically, in addition to the print key, the selection key, the delete key, the cursor key, and the like.

Figure 14A:
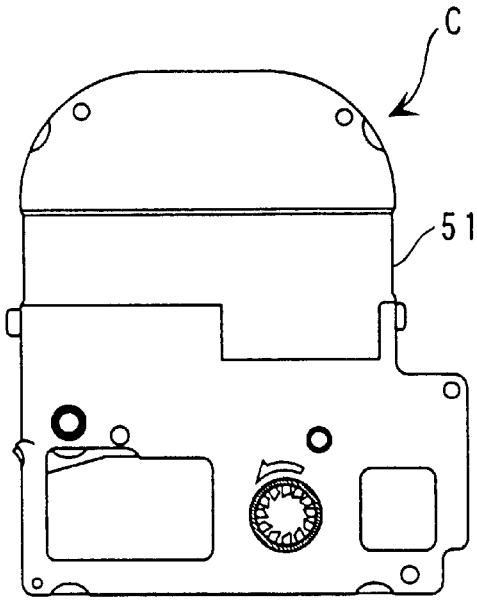
FIG. 14A is a top view showing the top of a tape cartridge.
Figure 14B:
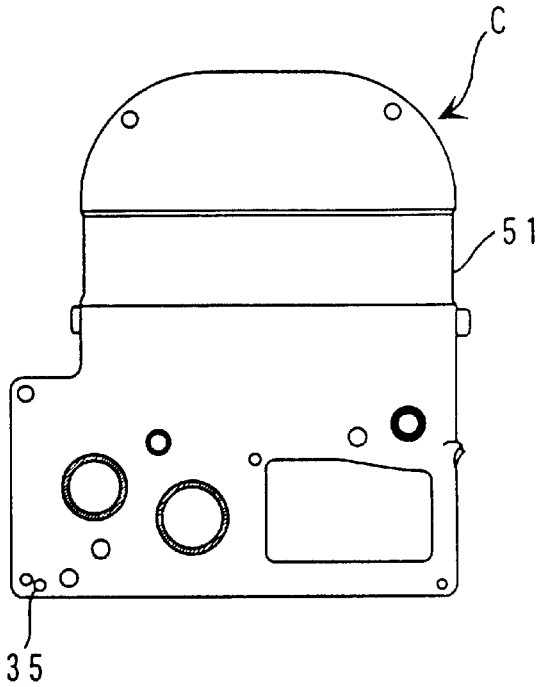
FIG. 14B is a bottom view showing the bottom of the tape cartridge.
Figure 14C:
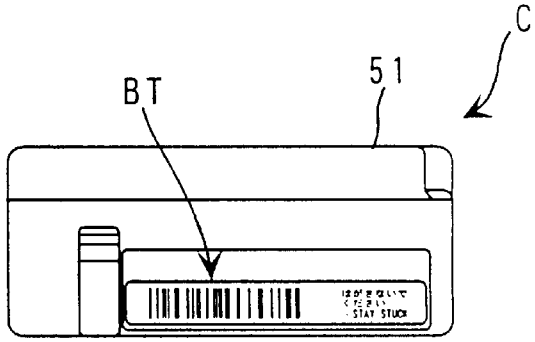
FIG. 14C is a rear view showing the rear of the tape cartridge.

As shown in FIGS. 14A and 14B, the tape cartridge C has a plurality of small holes 35 formed in the bottom thereof for discrimination of the type of the tape T contained therein from the other types of the tape T having different widths, which are contained in the other types of tape cartridges C. The compartment P has a tape width-detecting sensor 143 comprised of micro-switches or the like, for detecting the above holes to thereby determine the type of the tape T set for use. Further, as shown in FIG. 14C, in the present embodiment, a barcode tape BT which has information of the materials, thicknesses, colors, and the like of members forming a tape T accommodated in the cartridge casing 51 is affixed to the bottom surface of the cartridge casing 51. The information encoded as a barcode can be detected by a tape information-detecting sensor 145 implemented by a photo sensor or the like. For instance, in the case of a standard tape, the tape information includes material and thickness information of polyethylene terephthalate (55 $\mu$m), acrylic resin (2 $\mu$m), and wood free paper (40 $\mu$m), and other information of a tape color of white and a ribbon color of blue.

Figure 13A:
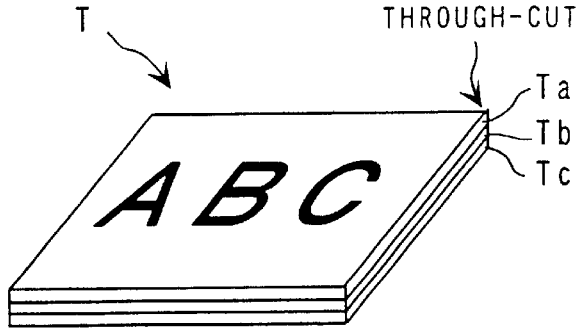
FIGS. 13A to 13C are diagrams showing layer structures of tapes used in the tape printing apparatus according to the second embodiment.

Referring to FIG. 13A, the tape T accommodated in the tape cartridge C is comprised of an image-receiving layer Ta which serves as a printing surface, an adhesive layer Tb formed on the reverse side thereof, and a peel layer Tc arranged on the reverse side of the adhesive layer Tb. After printing, the image-receiving layer Ta and the adhesive layer Tb are peeled off the peel layer Tc to be affixed to an object article.

Figure 13B:
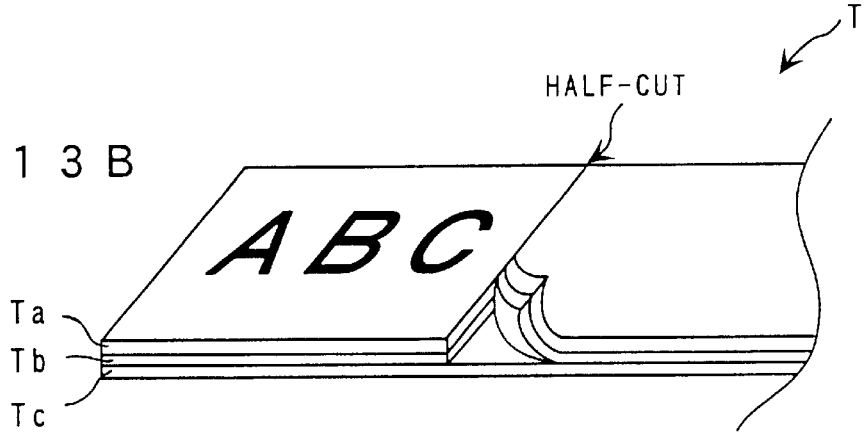

The results of cutting operations carried out by the through-cutting tape cutter 132*a* and the half-cutting tape cutter 132*b* according to the cutting method of the present embodiment are shown in FIGS. 13A and 13B.

To selectively carry out one of two cutting operations, i.e. a manual cutting operation and an automatic cutting operation, the tape printing apparatus 1 is capable of being switched between a manual cutting mode and an automatic cutting mode according to a mode-setting operation. It should be noted that in the automatic cutting mode, when the apparatus 1 has been set to perform half-cutting, the half-cutting tape cutter 132*b* is driven, whereas when no particular cutting method is designated, the through-cutting tape cutter 132*a* is driven.

When the automatic cutting mode is set by the mode-setting operation, the type of the tape T is detected by the tape width-detecting sensor 143, referred to hereinafter, and based on a result of the detection, whether or not the cutter motor 131 should be driven is set. More specifically, whether or not both through-cutting and half-cutting should be carried out is set based on a result of the detection. It should be noted that the apparatus may be constructed such that the user can set whether or not the cutting process should be carried out, separately or individually for through-cutting and half-cutting. According to this construction, when it is detected that it is no use to carry out half-cutting of a tape T set for use since the tape T is formed of only one layer although the material and thickness thereof are suitable for the half-cutting, it is possible to set the apparatus to carry out through-cutting but not half-cutting.

The sensor block 15 includes the tape information-detecting sensor 145, the rotational speed sensor 141, and the tape width-detecting sensor 143, as described above. It should be noted that the above sensors can be omitted to suit the actual requirements of the tape printing apparatus.

The ROM 220 of the control block 200 has a control data area 222 for storing control data including a cuttable material table which provides listing of materials of the tape-shaped member capable of being cut, in addition to the character list table, the color conversion table, and the character modification table.

The CPU 210 of the control block 200 further controls cutting of the tape T, similarly to the first embodiment.

When the CPU 210 controls cutting of the tape T, the materials and thickness (sum total of thicknesses) of the tape T are detected by the tape information-detecting sensor 145. After that, it is determined whether or not the detected materials conform to cuttable materials stored in the control data area 222, and whether or not the detected sum total of thicknesses of the tape T is equal to or smaller than a predetermined cuttable thickness (200 ( $\mu$m)). If it is determined that the tape T is formed only by members made of cuttable materials, and at the same time the tape T has a thickness equal to or smaller than the predetermined sum total of thicknesses, the cutter motor 131 is driven via the cutter motor driver 273*c*.

Now, an automatic cutting function-setting process of the tape printing apparatus 1 will be described. As described above, in the tape printing apparatus 1 according to the present invention, the tape information-detecting sensor 145 detects information of the tape T (whether or not the mounted tape T is formed only by members made of cuttable materials, and whether or not the tape T has a thickness equal to or smaller than the predetermined sum total of thicknesses (200($\mu$m)), and based on the results of the detection, the ON/OFF setting of the automatic cutting function is performed. Only when the mounted tape T is formed only by cuttable materials, and at the same time the sum total of thicknesses of the tape T is equal to or smaller than 200($\mu$m), the automatic cutting function is set to ON, whereas when the above conditions are not fulfilled, the automatic cutting function is set to OFF. That is, if the mounted tape T includes an uncuttable material, the automatic cutting function is set to"OFF"irrespective of the thickness of the tape, and even when the mounted tape T is formed only by members made of cuttable materials, if the sum total of thicknesses of the tape T exceeds 200(μm), the automatic cutting function is set to OFF. For instance, in the case of a luminous tape (receptor tape), the tape is formed only by members made of cuttable materials, but the sum total of thicknesses of the tape is equal to 252(μm), so that the automatic cutting function is set to OFF.

Now, the overall flow of the automatic cutting function-setting process according to the invention will be described with reference to FIG. 10. Here, let it be assumed that the cutting mode is set not to the "manual cutting mode" but to the "automatic cutting mode", and that a tape T (tape cartridge C) is mounted after the power is turned on. Further, hereinafter, a tape T which can be cut is referred to as a "cuttable tape Ti", and a tape T which cannot cut is referred to as an"uncuttable tape T2".

Figure 10:
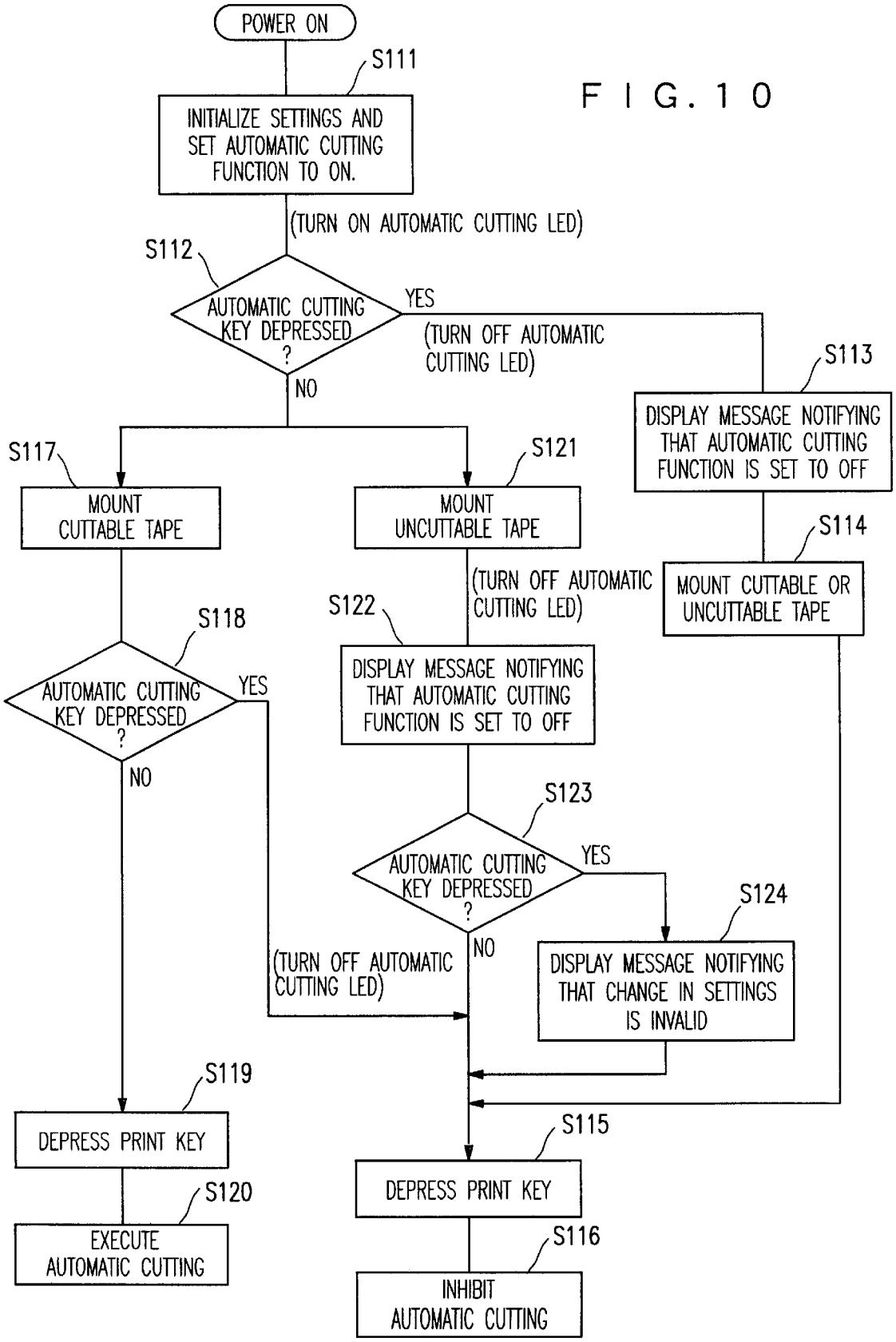
FIG. 10 is a flowchart showing an overall flow of an automatic cutting function-setting process carried out by the tape printing apparatus according to the second embodiment.

Referring to FIG. 10, when the power is turned on by the user, a predetermined initialization of the system is carried out at a step Sill. Here, when the power of the tape printing apparatus 1 was turned off the last time, if the automatic cutting function was set to ON, the ON state of the automatic cutting function is maintained. On the other hand, when the power of the tape printing apparatus 1 was turned off the last time, if the automatic cutting function was set to OFF, the automatic cutting function is also set to OFF after the power is turned on. It is assumed here that when the power of the tape printing apparatus 1 was turned off the last time, the automatic cutting function was set to ON. Hence, the automatic cutting function is set to ON, and in accordance with this setting, and the automatic cutting indicator lamp (hereinafter referred to as the "automatic cutting LED") 42' arranged at the central portion of the crescent-shaped block 9 is lighted.

Figure 11:
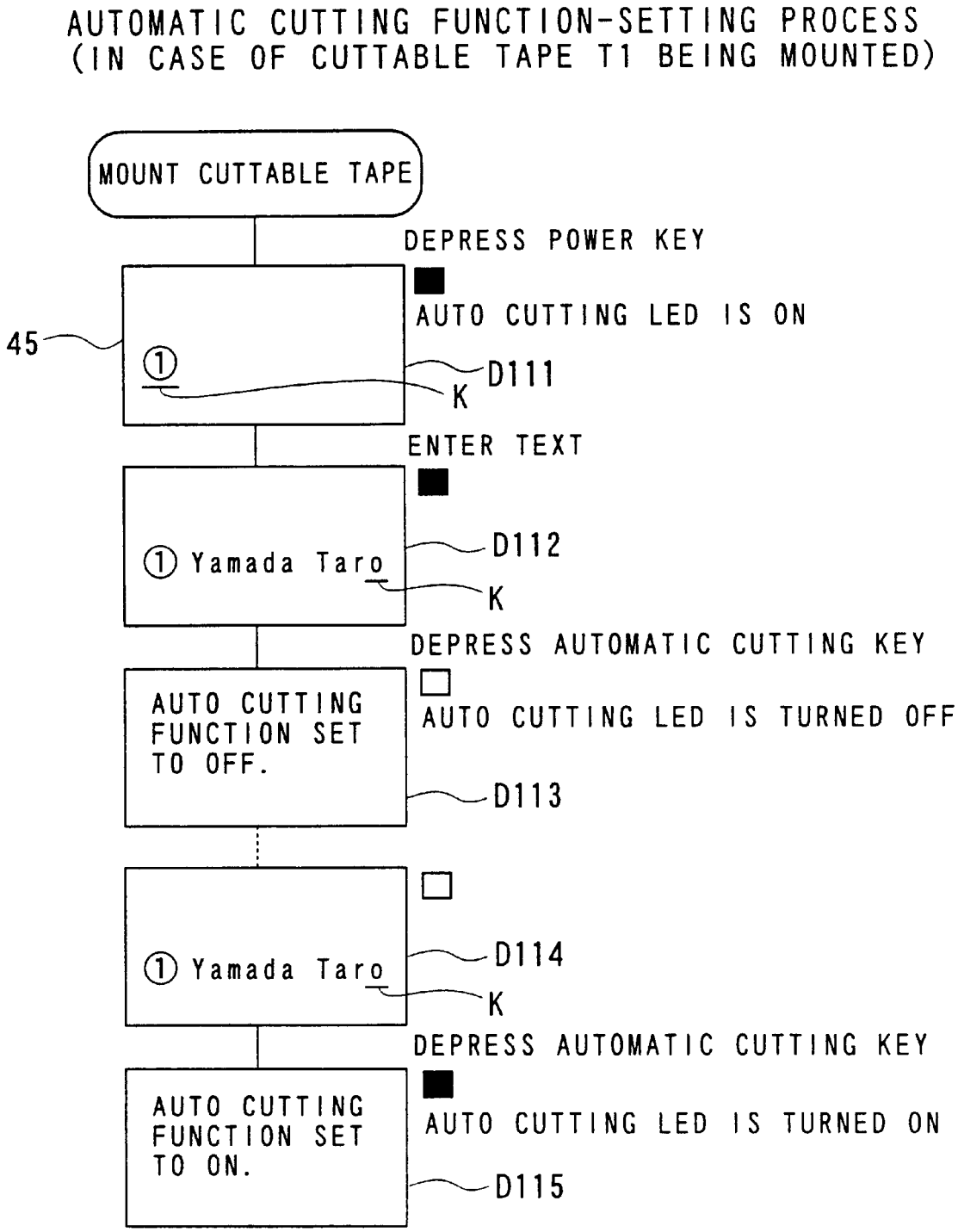
FIG. 11 is a diagram showing an example of an automatic cutting function-setting process when a cuttable tape is set in the tape printing apparatus, together with images displayed on a display screen.

After the automatic cutting LED 42' is lighted, when the automatic cutting key is depressed by the user (Yes to S112), the automatic cutting LED 42' is turned off, and a message notifying the user that the automatic cutting function is set to OFF is displayed at a step S113 (see D113 in FIG. 11). In this state, when a tape T is mounted at a step S114 (in this case, the tape T may be a cuttable tape or an cuttable tape), and the print key is depressed at a step S115, automatic cutting of the tape T is not carried out only to perform printing at a step S116. In this case, the user cuts the tape T with scissors or the like.

On the other hand, when the automatic cutting key is not depressed by the user (No to S112), and the cuttable tape Ti is mounted thereafter at a step S117, if the print key is depressed at a step S119 (without depressing the automatic cutting key at a step S118 (No to S118), automatic cutting of the tape Ti is performed at a step S120. It should be noted that in this case, in the automatic cutting mode, a half-cutting operation is performed when the apparatus 1 is set to perform half-cutting, whereas when no particular cutting method is designated, a through-cutting operation is carried out.

Further, after the cuttable tape T1 is mounted at the step S117, if the automatic cutting key is depressed by the user at the step S118 (Yes to S118), the automatic cutting LED 42' is turned off, and when the print key is depressed by the user at the step S115, automatic cutting is not carried out only to perform a printing operation at the step S116.

Figure 12:
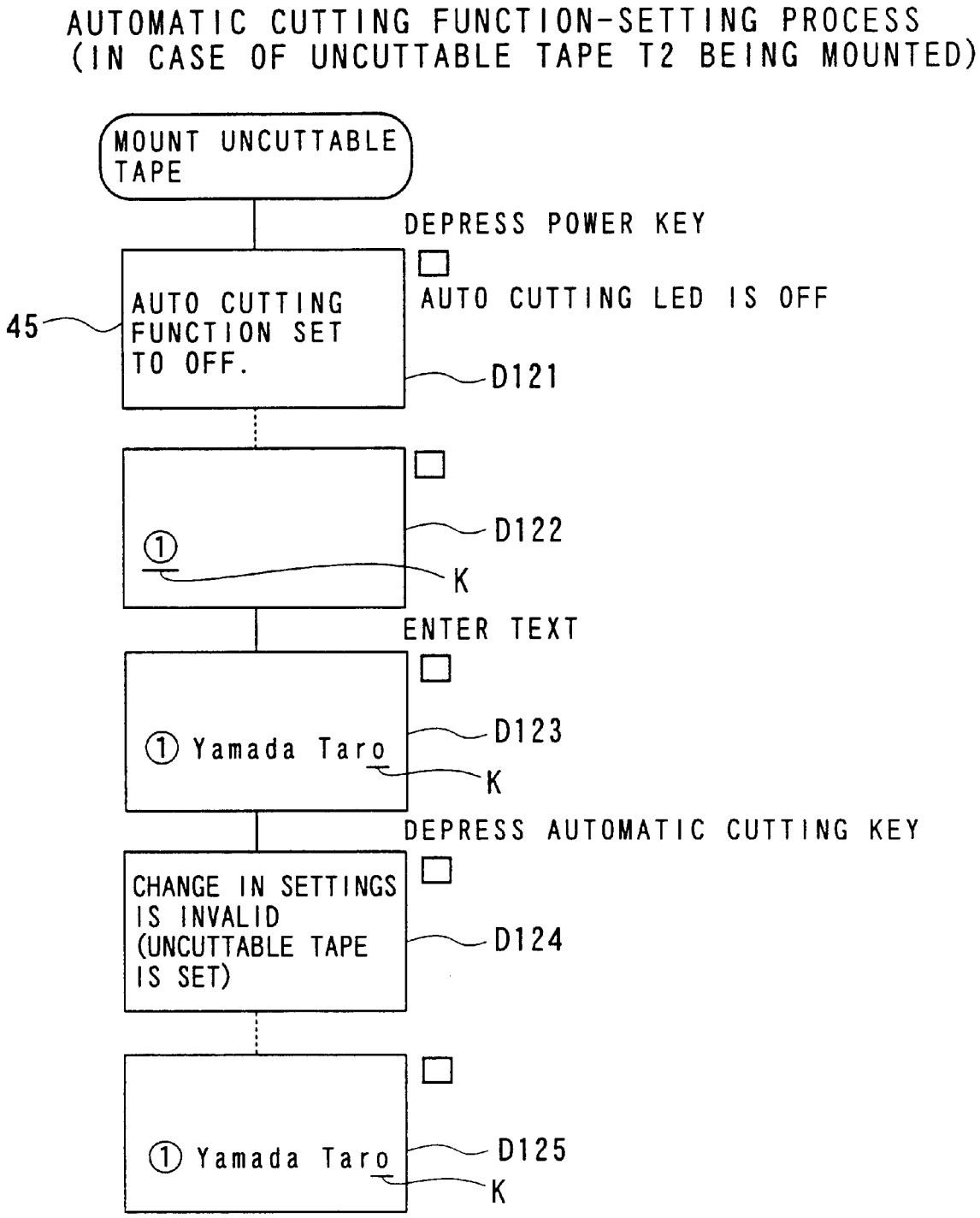
FIG. 12 is a diagram showing an example of the automatic cutting function-setting process when an uncuttable tape is set in the tape printing apparatus, together with images displayed on the display screen.

If the uncuttable tape T2 is mounted by the user at a step S121, the automatic cutting LED 42' is turned off, and the message notifying the user that the automatic cutting function is set to OFF is displayed at a step S122 (see D121 in FIG. 12). Here, if (the automatic cutting key is not depressed (No to S123), and the print key is depressed at the step S115, the automatic cutting is not carried out only to perform a printing operation at the step S116. On the other hand, if the automatic cutting key is depressed (Yes to S123), a message notifying the user that the change in settings is invalid is displayed at a step S124 (see D124 in FIG. 12). This is for preventing an improper cutting operation from being effected in spite of the uncuttable tape T2 being mounted, thereby preventing the tape cutter 132 from being broken and abraded. Therefore, when the print key is depressed by the user at the step S115, the automatic cutting is not carried out only to perform a printing operation at the step S116.

It is preferred that if the apparatus is configured such that the power thereof is turned off when the tape T (cartridge C) is replaced (i.e. when the lid 5 is opened) so as to prevent removal of the tape T (cartridge C) being fed to thereby prevent a faulty printing operation, the apparatus is configured such that the type of tape T mounted therein is detected immediately after the power is tuned on. In this case, if the cuttable tape Ti is detected immediately after the power is tuned on, the step S118 et seq., described above, are carried out, whereas when the uncuttable tape T2 is detected, the step S122 et seq., described hereinabove, are carried out.

Therefore, as described above, the automatic cutting function-setting process of the tape printing apparatus which is configured such that the power thereof is turned off when the tape T is replaced will be described according to the operating procedure of the process with reference to images displayed on the display screen 45 in FIGS. 11 and 12. First, a case of the cuttable tape Ti being mounted in the apparatus will be described. As shown in FIG. 11, after the cuttable tape Ti is mounted, when the power key is depressed by the user, the text entry screen is displayed (D111). It should be noted that encircled number 1 appearing on the display screen 45 indicated that a letter string is to be entered on a first line of text data, and an underline drawn under the encircled number 1 represents a cursor K. Further, at this time, the automatic cutting LED 42' is on.

At this time, text data "Yamada Taro" is input (D112). Then, if the automatic cutting key is depressed, the automatic cutting LED 42' is turned off, and the message notifying the user that the automatic cutting function is set to OFF is displayed (D113). After the message has been displayed for one or two seconds, the screen is switched to the text entry screen (D114). In this state, if the automatic cutting key is further depressed, the automatic cutting LED 42' is turned on, and a message notifying the user that the automatic cutting function is set to ON is displayed Next, a case of the uncuttable tape T2 being mounted in the apparatus will be described. Referring to FIG. 12, after the uncuttable tape T2 is mounted, if the power key is depressed by the user, the message notifying the user that the automatic cutting function has been automatically set to OFF is displayed (D121). At this time, the automatic cutting LED 42' is off. Further, after the message has been displayed for one or two seconds, the screen is switched to the text entry screen (D122).

Here, after the text data"Yamada Taro" is input (D123), if the automatic cutting key is depressed, the message notifying the user that the change in settings is invalid is displayed (D124) since the uncuttable tape T2 has been mounted. After the message has been displayed for one or two seconds, the screen is switched to the text entry screen (D125). It should be noted that in FIGS. 11 and 12, text ("Yamada Taro") is arbitrarily input irrespective of the setting of the automatic cutting function and has no particular relationship between with the automatic cutting function.

As described hereinbefore, according to the cutting device, the tape printing apparatus incorporating the device, and the cutting method, of the present embodiment, it is possible to detect the information (materials and thickness) of the tape T, and automatically set according to the results of the detection whether or not the tape T should be cut. Therefore, the user does not have to carry out setting as to whether or not the automatic cutting should be carried out. This makes it possible to simplify the operation required for the cutting process as well as prevent improper cutting of a tape-shaped member which would cause the breakage and abrasion of a tape cutter if it is cut by the tape cutter. Further, when the cuttable tape Ti is employed, it is possible to change settings such that automatic cutting is inhibited in accordance with the user's instruction. Further, the automatic cutting LED 42' notifies the user whether or not automatic cutting is to be carried out, and when the settings of the automatic cutting function are changed, the notification of the fact is displayed on the display screen 45, which contributes to enhanced operability of the apparatus.

Although in the above-mentioned example, it is assumed that the cutting mode is set to the "automatic cutting mode", this is not limitative, but also when the "manual cutting mode" is set as the cutting mode, if the uncuttable tape T2 is used, the apparatus may be configured not to be capable of performing any cutting process. According to this configuration, it is possible to prevent the tape cutter 132 from being broken and abraded when the uncuttable tape T2 is cut by mistake irrespective of the cutting mode set or determined.

Figure 13C:
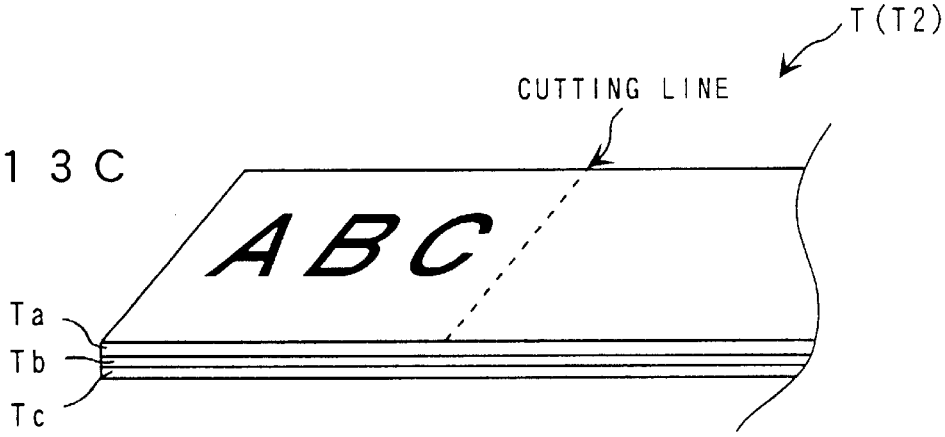

Further, when no cutting process is performed (i.e. when the uncuttable tape T2 is detected), as shown in FIG. 13C, the apparatus may be configured such that a cutting line (shown by a dotted line in the figure) indicative of a cutting position is printed on a tape. According to this configuration, the user can confirm a suitable cutting position at a glance when he cuts the tape with scissors or the like. Further, when a tape having a large width is employed, the tape can be cut straight along the cutting line, thereby making it possible to produce an attractive print (label).

Although in the above example, it is assumed that when the tape T is mounted (S114 in FIG. 10) after the automatic cutting function is set to OFF (S112, S113 in the figure), the automatic cutting is not carried out (S116 in the figure) irrespective of whether or not the tape is cuttable, this is not limitative, but here, if the cuttable tape T1 is mounted, the apparatus may be configured to perform the automatic cutting. In short, the apparatus may be configured such that the automatic cutting function can be set according to the type of the tape T irrespective of the user's instruction. According to this construction, it is possible to effect an appropriate cutting process conforming to the type of the tape T even when the user provides an erroneous instruction.

Further, although in the above example, it is assumed that the materials and thickness of the tape T are detected, the apparatus may be configured so as to detect only the materials of the tape T. Further, the apparatus may be configured such that information as to the hardness and adhesion of each of the members forming the tape T is stored beforehand in the barcode tape BT for detection. More specifically, in this case, if the detected hardness and adhesion of each of the members forming the tape T is equal to or lower than a predetermined hardness and adhesion, the apparatus is set to perform the automatic cutting. According to this configuration, it is possible to prevent erroneous cutting of a tape T having a high hardness and adhesion, thereby preventing the tape cutter from undergoing breakage or degradation of cutting performance. Further, the amount of information to be detected can be reduced in comparison with a case in which the material of each of the members forming the tape T is detected.

Figure 15:
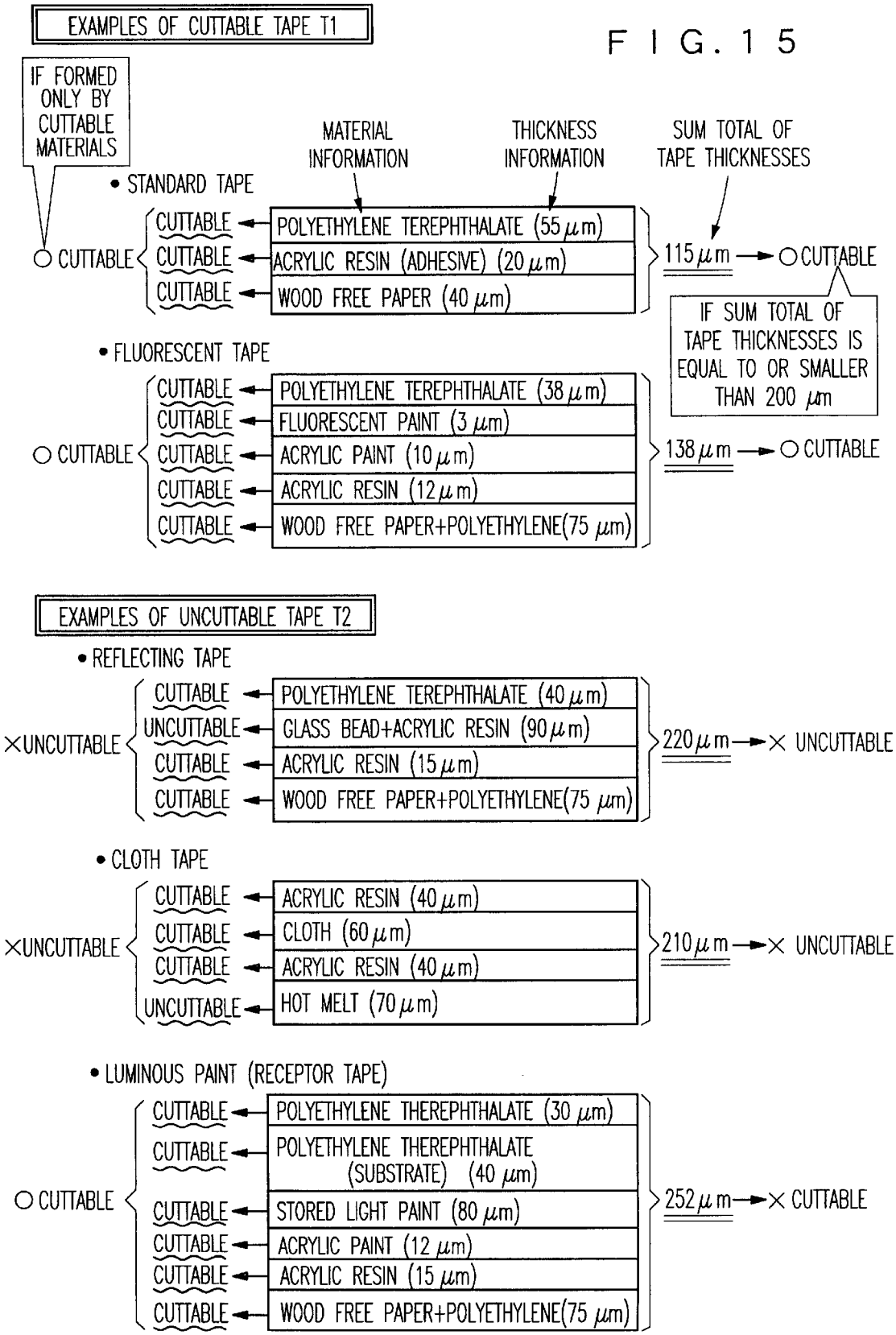
FIG. 15 is an explanatory view showing examples of cuttable tapes and uncuttable tapes.

The apparatus may be constructed to detect only the thickness (sum total of thicknesses) of the tape T (see double-underlined portions of "Examples of Cuttable Tape" and "Examples of Uncuttable Tape" in FIG. 15). According to this configuration, only whether or not the sum total of thicknesses of the tape T is equal to or larger than 200 ($\mu$m) bas to be detected, and hence it is possible to drastically reduce the amount of information to be detected. In short, it is possible to simplify the construction of an object to be detected.

Further, the apparatus may be configured to detect only whether or not the tape T mounted is comprised of only members made of cuttable materials (whether or not the tape T is cuttable) (see wavy underlined portions in FIG. 15). According to this configuration, it is possible to further simplify the construction of an object to be detected and that of a mechanism (tape information-detecting sensor 145, for instance) for detecting the object by using e.g. a plurality of small holes formed in the bottom of the cartridge casing 51 as objects to be detected, in place of the barcode tape BT.

Although in the above example, it is assumed that only cuttable materials are defined (data thereof is stored) on the tape printing apparatus 1 side, and a tape is determined to be "cuttable" when only the defined materials are detected from the tape, this is not limitative, but the apparatus may be configured to define (store data of) only "uncuttable" materials. According to this configuration, even when a tape T containing a cuttable material newly developed is used, the material is not defined to be "uncuttable", and hence the apparatus can correctly determine that the material is "cuttable". More specifically, if only "cuttable" materials are defined, the delay of a countermeasure against the development of a tape T causes the problem that the apparatus is set not to cut a tape-shaped member which is comprised of members made of cuttable materials, whereas when only "uncuttable" materials are defined, the apparatus can be prevented from suffering from such a problem. It should be noted that information of both "cuttable" and"uncuttable" materials may be defined (stored) within a range that the memory capacity of the apparatus allows.

Although in the above example, it is assumed that information of the tape T is detected by reading the barcode tape BT affixed to the bottom of the cartridge casing 51 by the tape information-detecting sensor 145, this is not limitative, but the apparatus may be configured to detect identifier tapes colored in accordance with the type of the tape T, such as a white tape indicating that the cuttable tape T1 is contained in the cartridge casing 51, and a black tape used indicating that the uncuttable tape T2 is contained in the cartridge casing 51. Further, the apparatus may be configured such that a plurality of tape information-detecting sensor 145 are arranged side by side to sense a plurality of reflection seals affixed to predetermined locations of the tape cartridge C, thereby detecting a relatively small amount of information, such as information of the thickness of the tape T, information as to whether or not the tape T is cuttable, and the like.

It is further understood by those skilled in the art that the foregoing are preferred embodiments of the invention, and that various changes and modifications may be made without departing from the spirit and scope thereof.

What is claimed is:

1. A tape printing apparatus which has a half-cutting function capable of cutting an image-receiving layer alone of a tape-shaped member in a direction of a width thereof by using a half cutter, the tape-shaped member having the image-receiving layer and a peel layer, the tape printing apparatus comprising:

printing means for printing on the tape-shaped member;

tape-detecting means for detecting a type of the tape-shaped member;

half cutter-driving setting means for setting whether or not said half cutter should be driven, based on a result of detection by said tape-detecting means; and half-cutting means for performing half-cutting of the image-receiving layer alone of the tape-shaped member at a forward location of the tape-shaped member in a direction of feed thereof by driving said half cutter when said half cutter-driving setting means sets said half cutter to be driven;

wherein said tape-detecting means includes means for detecting whether or not the tape-shaped member is cuttable; and wherein said, half cutter-driving setting means includes means for setting said half cutter to be driven only when said tape-detecting means detects that the tape-shaped member is cuttable.

2. A tape printing apparatus according to claim 1, wherein said tape-detecting means includes means for detecting whether or not the peel layer exists in the tape-shaped member, and wherein said half cutter-driving setting means includes means for setting the half cutter to be inhibited from being driven when it is detected by said tape-detecting means that the peel layer does not exist in the tape-shaped member.

3. A tape printing apparatus according to claim 1, further including half cutter-driving instructing means for instructing whether or not the half cutter should be driven by said half-cutting means, and wherein said half cutter-driving setting means includes means for setting the half cutter to be inhibited from being driven irrespective of contents of an instruction given by said half cutter-driving instructing means, when it is detected by said tape-detecting means that the peel layer does not exist in the tape-shaped member.

4. A tape printing apparatus according to claim 1, further including setting information-notifying means for notifying the user of settings set by said half cutter-driving setting means.

5. A tape printing apparatus according to claim 1, further including display means for displaying messages for the user, wherein said display means includes means for displaying a message notifying the user that the settings set by said half cutter-driving setting means are changed if the settings are changed.

6. A tape printing apparatus according to claim 5, further including half cutter-driving instructing means for instructing whether or not the half cutter should be driven by said half-cutting means, and wherein said display means includes means for displaying a message notifying the user that an instruction given by said half cutter-driving instructing means is made invalid, when it is detected by said tape-detecting means that the peel layer does not exist in the tape-shaped member.

7. A method of printing a tape-shaped member by using a tape printing apparatus which has a half-cutting function capable of cutting an image-receiving layer alone of the tape-shaped member in a direction of a width thereof by using a half cutter, the tape-shaped member having the image-receiving layer and a peel layer, the method comprising the steps of:

detecting a type of the tape-shaped member;

setting whether or not said half cutter should be driven, based on a result of the detection;

performing half-cutting of the image-receiving layer alone of the tape-shaped member at a forward location of the tape-shaped member in a direction of feed thereof by driving said half cutter when said half cutter is set to be driven; and printing on the tape-shaped member;

wherein the step of detecting a type of the tape-shaped member includes detecting whether or not the tape-shaped member is cuttable; and wherein the step of setting whether or not said half cutter should be driven includes setting said half cutter to be driven only when the tape-shaped member is detected to be cuttable.

8. A method according to claim 7, wherein the step of detecting a type of the tape-shaped member includes detecting whether or not the peel layer exists in the tape-shaped member, and wherein the step of whether or not the half cutter should be driven includes the step of setting the half cutter to be inhibited from being driven when it is detected that the peel layer does not exist in the tape-shaped member.

9. A tape printing apparatus which has a half-cutting function capable of cutting a peel layer alone of a tape-shaped member in a direction of a width thereof by using a half cutter, the tape-shaped member having an image-receiving layer and the peel layer, the tape printing apparatus comprising:

printing means for printing on the tape-shaped member;

tape-detecting means for detecting a type of the tape-shaped member;

half cutter-driving setting means for setting whether or not said half cutter should be driven, based on a result of detection by said tape-detecting means; and half-cutting means for performing half-cutting of the peel layer alone of the tape-shaped member at a forward location of the tape-shaped member in a direction of feed thereof by driving said half cutter when said half cutter-driving setting means sets said half cutter to be driven;

wherein said tape-detecting means includes means for detecting whether or not the tape-shaped member is cuttable; and wherein said half cutter-driving setting means includes means for setting said half cutter to be driven only when said tape-detecting means detects that the tape-shaped member is cuttable.

10. A cutting device which is capable of cutting a tape-shaped member by a tape cutter thereof, comprising:

tape-detecting means for detecting a type of the tape-shaped member;

tape cutter-driving setting means for setting whether or not said tape cutter should be driven, based on a result of detection by said tape-detecting means; and cutting means for cutting the tape-shaped member when said tape cutter-driving setting means sets said tape cutter to be driven;

wherein said tape-detecting means includes means for detecting whether or not the tape-shaped member is cuttable; and wherein said tape cutter-driving setting means includes means for setting said tape cutter to be driven only when said tape-detecting means detects that the tape-shaped member is cuttable.

11. A cutting device according to claim 10, further including setting information-notifying means for notifying the user of information of settings set by said tape cutter-driving setting means.

12. A cutting device according to claim 10 further including display means for displaying messages for the user, wherein said display means includes means for displaying a message notifying the user that the settings by said tape cutter-driving setting means are changed if the settings are changed.

13. A cutting device which is capable of cutting a tape-shaped member by a tape cutter thereof, comprising:

tape-detecting means for detecting a type of the tape-shaped member;

tape cutter-driving setting means for setting whether or not said tape cutter should be driven, based on a result of the detection by said tape-detection means; and cutting means for cutting the tape-shaped member when said tape cutter-driving setting means sets said tape cutter to be driven;

wherein said tape-detecting means includes means for detecting a thickness of the tape-shaped member; and wherein said tape cutter-driving setting means includes means for setting said tape cutter to be driven only when said tape-detecting means detects that the thickness of the tape-shaped member is equal to or smaller than a predetermined thickness defined in advance.

14. A cutting device which is capable of cutting a tape-shaped member by a tape cutter thereof, comprising:

tape-detecting means for detecting a type of the tape-shaped member;

tape cutter-driving setting means for setting whether or not said tape cutter should be driven, based on a result of detection by said tape-detecting means; and cutting means for cutting the tape-shaped member when said tape cutter-driving setting means sets said tape cutter to be driven;

wherein said tape-detecting means includes means for detecting materials of component parts forming the tape-shaped member; and wherein said tape cutter-driving setting means includes means for setting said tape cutter to be driven only when the materials of the component parts detected by said tape-detecting means are predetermined cuttable materials defined in advance.

15. A cutting device which is capable of cutting a tape-shaped member by a tape cutter thereof, comprising:

tape-detecting means for detecting a type of the tape-shaped member;

tape cutter-driving setting means for setting whether or not said tape cutter should be driven, based on a result of the detection by said tape-detecting means;

cutting means for cutting the tape-shaped member when said tape cutter-driving setting means sets said tape cutter to be driven;

wherein said tape-detecting means includes means for detecting materials of component parts forming the tape-shaped member;

wherein said tape cutter-driving setting means includes means for setting said tape cutter to be driven only when the materials of the component parts detected by said tape-detecting means are predetermined cuttable materials defined in advance; and wherein said tape cutter-driving setting means includes means for setting said tape cutter to be inhibited from being driven only when the materials of the component parts detected by said tape-detecting means are predetermined uncuttable materials defined in advance.

16. A cutting device which is capable of cutting a tape-shaped member by a tape cutter thereof, comprising:

tape-detecting means for detecting a type of the tape-shaped member;

tape cutter-driving setting means for setting whether or not said tape cutter should be driven, based on a result of detection by said tape-detecting means; and cutting means for cutting the tape-shaped member when said tape cutter-driving setting means sets said tape cutter to be driven;

wherein said tape-detecting means includes means for detecting a hardness of each of the component parts forming the tape-shaped member; and wherein said tape cutter-driving setting means includes means for setting said tape cutter to be driven only when the hardness of each of the component parts detected by said tape-detecting means is equal to or smaller than a predetermined hardness defined in advance.

17. A cutting device which is capable of cutting a tape-shaped member by a tape cutter thereof, comprising:

tape-detecting means for detecting a type of the tape-shaped member;

tape cutter-driving setting means for setting whether or not said tape cutter should be driven, based on a result of detection by said tape-detecting means; and cutting means for cutting the tape-shaped member when said tape cutter-driving setting means sets said tape cutter to be driven;

wherein said tape-detecting means includes means for detecting an adhesion between the component parts forming the tape-shaped member; and wherein said tape cutter-driving setting means includes means for setting said tape cutter to be driven only when the adhesion of each of the component parts detected by said tape-detecting means is equal to or smaller than a predetermined adhesion value defined in advance.

18. A cutting device which is capable of cutting a tape-shaped member by a tape cutter thereof, comprising:

tape-detecting means for detecting a type of the tape-shaped member;

tape cutter-driving setting means for setting whether or not said tape cutter should be driven, based on a result of detection by said tape-detecting means;

cutting means for cutting the tape-shaped member when said tape cutter-driving setting means sets said tape cutter to be driven; and tape cutter-driving instructing means for instructing whether or not said tape cutter should be driven;

wherein said tape cutter-driving setting means includes means for setting whether or not said tape cutter should be driven based on an instruction given by said tape cutter-driving instructing means; and wherein said tape cutter-driving setting means includes means for setting said tape cutter to be inhibited from being driven irrespective of the instruction given by said tape cutter-driving instructing means, when it is detected by said tape-detecting means that the tape-shaped member is uncuttable.

19. A cutting device which is capable of cutting a tape-shaped member by a tape cutter thereof, comprising:

tape-detecting means for detecting a type of the tape-shaped member;

tape cutter-driving setting means for setting whether or not said tape cutter should be driven, based on a result of detection by said tape-detecting means;

cutting means for cutting the tape-shaped member when said tape cutter-driving setting means sets said tape cutter to be driven; and display means for displaying messages for the user;

wherein said display means includes means for displaying a message notifying the user that the settings by said tape cutter-driving setting means are changed if the settings are changed;

further including tape cutter-driving instructing means for instructing whether or not said tape cutter should be driven; and wherein said display means includes means for displaying a message notifying the user that the instruction given by said tape cutter-driving instructing means is made invalid, when it is detected by said tape-detecting means that the tape-shaped member is uncuttable.

20. A method of cutting a tape-shaped member by using a tape cutter, comprising the steps of:

detecting a type of the tape-shaped member;

setting whether or not said tape cutter should be driven, based on a result of the detection; and cutting the tape-shaped member when said tape cutter is set to be driven;

wherein the step of detecting a type of the tape-shaped member includes detecting whether or not the tape-shaped member is cuttable; and wherein the step of setting whether or not the tape cutter should be driven includes setting said tape cutter to be driven only when the tape-shaped member is detected to be cuttable.

21. A method of cutting a tape-shaped member by using a tape cutter, comprising the steps of:

detecting a type of the tape-shaped member;

setting whether or not said tape cutter should be driven, based on a result of the detection; and cutting the tape-shaped member when said tape cutter is set to be driven;

wherein the step of detecting a type of the tape-shaped member includes detecting a thickness of the tape-shaped member; and wherein the step of setting whether or not said tape cutter should be driven includes setting said tape cutter to be driven only when the thickness of the tape-shaped member is detected to be equal to or smaller than a predetermined thickness defined in advance.

22. A method of cutting a tape-shaped member by using a tape cutter, comprising the steps of:

detecting a type of the tape-shaped member;

setting whether or not said tape cutter should be driven, based on a result of the detection; and cutting the tape-shaped member when said tape cutter is set to be driven;

wherein the step of detecting a type of the tape-shaped member includes detecting materials of component parts forming the tape-shaped member; and wherein the step of setting whether or not said tape cutter should be driven includes setting said tape cutter to be driven only when said materials of the component parts are detected to be predetermined cuttable materials defined in advance.

23. A method of cutting a tape-shaped member by using a tape cutter, comprising the steps of:

detecting a type of the tape-shaped member;

setting whether or not said tape cutter should be driven, based on a result of the detection; and cutting the tape-shaped member when said tape cutter is set to be driven;

wherein the step of detecting a type of the tape-shaped member includes a detecting materials of component parts forming the tape-shaped member; and wherein the step of setting whether or not said tape cutter should be driven includes setting said tape cutter to be driven only when said materials of the component parts are detected to be predetermined cuttable materials defined in advance; and setting said tape cutter to be inhibited from being driven only when the materials of the component parts are detected to be predetermined uncuttable materials defined in advance.

* * * * *